US012179897B1

(12) United States Patent
Johnson et al.

(10) Patent No.: US 12,179,897 B1
(45) Date of Patent: Dec. 31, 2024

(54) MARINE ENGINE ASSEMBLY

(71) Applicant: BRP US INC., Sturtevant, WI (US)

(72) Inventors: Justin Johnson, Silver Lake, WI (US); Roger Raetzman, Pleasant Prairie, WI (US); Todd Craft, Pleasant Prairie, WI (US); Claude Trahan, Shefford (CA)

(73) Assignee: BRP US Inc.

( * ) Notice: Subject to any disclaimer, the term of this patent is extended or adjusted under 35 U.S.C. 154(b) by 456 days.

(21) Appl. No.: 17/710,352

(22) Filed: Mar. 31, 2022

Related U.S. Application Data

(60) Provisional application No. 63/168,832, filed on Mar. 31, 2021.

(51) Int. Cl.

| | |
|---|---|
| ***B63H 20/28*** | (2006.01) |
| ***B63H 20/12*** | (2006.01) |
| ***B63H 20/24*** | (2006.01) |
| ***B63H 20/32*** | (2006.01) |
| ***F01P 3/20*** | (2006.01) |

(52) U.S. Cl.
CPC ..... *B63H 20/28* (2013.01); *B63H 20/12* (2013.01); *B63H 20/245* (2013.01); *B63H 20/32* (2013.01); *F01P 3/202* (2013.01); *B63H 2020/323* (2013.01)

(58) Field of Classification Search
CPC ..... B63H 20/00; B63H 20/04; B63H 20/12; B63H 20/245; B63H 20/28; B63H 20/32; F01P 3/202
USPC ..... 440/88 R
See application file for complete search history.

(56) References Cited

U.S. PATENT DOCUMENTS

| | | | |
|---|---|---|---|
| 2,207,372 | A | 7/1940 | Clarke |
| 2,216,496 | A | 10/1940 | Mackay |
| 3,164,122 | A | 1/1965 | Fageol |
| 3,269,351 | A | 8/1966 | Shimanckas |
| 3,452,704 | A | 7/1969 | Watkins |
| 3,911,853 | A | 10/1975 | Strang |
| 4,178,873 | A | 12/1979 | Bankstahl |
| 4,504,237 | A | 3/1985 | Blanchard |
| 4,559,018 | A | 12/1985 | Nakahama et al. |
| 4,666,410 | A | 5/1987 | Anselm |
| 4,726,799 | A | 2/1988 | Harada et al. |
| 4,773,215 | A | 9/1988 | Winberg et al. |
| 5,176,551 | A | 1/1993 | Blanchard et al. |
| 5,344,350 | A | 9/1994 | Hatch |
| 5,472,361 | A | 12/1995 | Fujimoto |
| 5,562,511 | A | 10/1996 | Blanchard et al. |
| 5,996,734 | A | 12/1999 | Blanchard et al. |

(Continued)

*Primary Examiner* — Lars A Olson
(74) *Attorney, Agent, or Firm* — BCF LLP

(57) ABSTRACT

A marine engine assembly has a housing including an outer housing having a front wall, an inner housing disposed in the outer housing and being connected to the outer housing by at least one housing fastener disposed at at least one first position, a cover removably connected to the outer housing, and a gearcase connected to a lower portion of the outer housing. An internal combustion engine has a front face connected to and supported by the inner housing by at least one engine fastener disposed at at least one second position being different from the at least one first position, and a crankshaft defining a crankshaft axis intersecting the front wall of the outer housing. The inner housing is disposed at least in part between the front face of the internal combustion engine and the front wall of the outer housing.

22 Claims, 20 Drawing Sheets

(56) References Cited

U.S. PATENT DOCUMENTS

| | | | | |
|---|---|---|---|---|
| 7,510,451 | B2 | 3/2009 | Naba | |
| 7,736,206 | B1 | 6/2010 | McChesney et al. | |
| D714,345 | S | 9/2014 | Petit et al. | |
| 8,826,845 | B2 | 9/2014 | Mochizuki | |
| 8,858,282 | B2 | 10/2014 | Lonnborg et al. | |
| 9,051,041 | B2 | 6/2015 | Litjens et al. | |
| 9,216,795 | B2 | 12/2015 | McGill | |
| 9,254,904 | B2 | 2/2016 | Minoura | |
| 9,296,456 | B2 | 3/2016 | Mochizuki et al. | |
| 9,499,247 | B1 | 11/2016 | Wiatrowski et al. | |
| 10,850,820 | B1 | 12/2020 | Minogue | |
| 11,180,235 | B2 | 11/2021 | Wiatrowski | |
| 11,492,088 | B1 * | 11/2022 | Broughton | B63H 20/04 |
| 11,498,653 | B1 * | 11/2022 | Broughton | B63H 20/245 |
| 11,505,299 | B1 * | 11/2022 | Broughton | B63H 20/32 |
| 11,767,092 | B2 * | 9/2023 | Broughton | B63H 20/04<br>440/52 |
| 2019/0233073 | A1 | 8/2019 | Wiatrowski | |

* cited by examiner

MARINE ENGINE ASSEMBLY

CROSS-REFERENCE

The present application claims priority to U.S. Provisional Patent Application No. 63/168,832, filed Mar. 31, 2021 entitled "Marine Engine Assembly", which is incorporated by reference herein in its entirety.

TECHNICAL FIELD

The present technology relates to marine engine assemblies.

BACKGROUND

A typical marine outboard engine assembly has an internal combustion engine disposed inside an engine housing, a gearcase supporting a propeller, and a midsection extending between the engine housing and the gearcase.

The outboard engine assembly is generally connected to a watercraft by a transom or mounting bracket, typically connected to the midsection, below the engine. The bracket connects to a rear portion of the watercraft, such that the engine and part of the midsection are well above the water during normal operation. In some cases, however, it could be preferable to have a marine engine assembly which is disposed lower relative to the watercraft to allow more useable room at the rear of the watercraft for example. However, by positioning a typical marine outboard engine lower relative to the watercraft, the propeller may now extend too deeply in the water, thereby compromising shallow water operation of the watercraft.

One solution could consist in reducing a length of the midsection or in eliminating the midsection altogether. However, this creates a number of problems. One of these problems is to package all of the necessary components of the marine engine assembly inside the housing and gearcase. U.S. Pat. No. 5,344,350 describes a marine outboard engine without a midsection, having a conventional vertically-oriented crankshaft and a power head (engine block, crankshaft, pistons, cylinder head(s) and valves). However, this arrangement has the downside that increasing the size of the engine, for example by adding cylinders, will increase the height of the engine, which can reduce the useable room at the rear of the watercraft and/or compromise shallow water operation of the watercraft, among other things.

There is therefore a desire for improvements in the way the components of a marine engine assembly are packaged while not increasing the overall height of the engine.

SUMMARY

It is an object of the present technology to ameliorate at least some of the inconveniences present in the prior art.

The present technology provides a semi-submerged marine engine assembly with the engine arranged and mounted substantially horizontally when the marine engine assembly is in a neutral trim position, i.e. with a substantially horizontal crankshaft. The present technology also provides for a semi-submerged marine engine assembly having a high rise exhaust passage that extends upwards, toward the tilt-trim axis, before the exhaust passage extends downwards to supply the exhaust gases from the engine downwards to the gearcase.

According to one aspect of the present technology, there is provided a marine engine assembly for a watercraft having a housing including an outer housing having a front wall, an inner housing disposed in the outer housing and being connected to the outer housing by at least one housing fastener disposed at at least one first position, the inner housing forming a high rise exhaust passage, a cover removably connected to the outer housing, and a gearcase connected to a lower portion of the outer housing. The marine engine assembly further includes an internal combustion engine having a front face connected to and supported by the inner housing by at least one engine fastener disposed at at least one second position being different from the at least one first position, the inner housing being disposed at least in part between the front face of the internal combustion engine and the front wall of the outer housing, the internal combustion engine and the inner housing being housed in a volume defined between the outer housing and the cover, the internal combustion engine further including a crankshaft defining a crankshaft axis, the crankshaft axis intersecting the front wall of the outer housing. The marine engine assembly further has a driveshaft assembly including a driveshaft being operatively connected to the crankshaft and extending perpendicular to the crankshaft axis, the driveshaft being housed at least in part in the gearcase, and a propulsion device supported by the gearcase and being operatively connected to the crankshaft through the driveshaft assembly.

In some implementations, the at least one housing fastener includes a first plurality of housing fasteners and a second plurality of housing fasteners, the first plurality of housing fasteners extends above the at least one engine fastener, and the second plurality of housing fasteners extends below the at least one engine fastener.

In some implementations, the first plurality of housing fasteners includes first threaded fasteners connecting an upper portion of the inner housing to an upper portion of the outer housing.

In some implementations, the second plurality of housing fasteners includes second threaded fasteners that extend upwards through the lower portion of the outer housing and into the inner housing to connect a lower portion of the inner housing to the lower portion of the outer housing.

In some implementations, the second threaded fasteners are disposed around the driveshaft.

In some implementations, the front wall of the outer housing defines at least one aperture at least partially aligned with the at least one engine fastener, the at least one aperture granting access to the at least one engine fastener.

In some implementations, the marine engine assembly further includes at least one cap disposed in the at least one aperture and being removably connected to the front wall of the outer housing for selectively granting access to the at least one engine fastener.

In some implementations, the at least one engine fastener includes a plurality of engine fasteners, and the engine fasteners of the plurality of engine fasteners extend forwardly from the front face of the internal combustion engine and through the inner housing to connect the front face of the internal combustion engine to the inner housing.

In some implementations, the engine fasteners of the plurality of engine fasteners are disposed above the crankshaft.

In some implementations, the driveshaft assembly is housed at least in part in the inner housing.

In some implementations, the driveshaft is housed at least in part in the inner housing.

In some implementations, the driveshaft is a first driveshaft, the driveshaft assembly further includes a second driveshaft operatively connected to the first driveshaft, the second driveshaft is perpendicular to the first driveshaft, the second driveshaft is operatively connected to the crankshaft, and the propulsion device is operatively connected to the first driveshaft.

In some implementations, the marine engine assembly further includes an exhaust system for supplying exhaust gases from the internal combustion engine to an exterior of the marine engine assembly, the exhaust system including the high rise exhaust passage, the internal combustion engine defining exhaust outlets fluidly communicating with the exhaust system, the high rise exhaust passage of the inner housing having an inlet and an outlet, the inlet of the high rise exhaust passage fluidly communicating with the exhaust outlets of the internal combustion engine, and the outlet of the high rise exhaust passage fluidly communicating with the gearcase for supplying at least some of the exhaust gases from the exhaust outlets to the gearcase.

In some implementations, the exhaust system further includes an idle relief exhaust system including an idle relief passage defined in the inner housing, the idle relief passage being fluidly connected to the high rise exhaust passage between the inlet and the outlet of the high rise exhaust passage.

In some implementations, the marine engine assembly further includes a cooling system including at least one water intake defined in the gearcase, a water pump housed in at least one of the gearcase and the inner housing, the water pump having an inlet fluidly connected to the at least one water intake and an outlet, and inner housing cooling water passages formed in the inner housing and fluidly connected to the outlet of the water pump.

In some implementations, the marine engine assembly further includes engine cooling water passages fluidly connected to the inner housing cooling water passages for cooling the internal combustion engine.

In some implementations, the marine engine assembly further includes driveshaft assembly cooling water passages fluidly connected to the inner housing cooling water passages for cooling the driveshaft assembly.

In some implementations, the marine engine assembly further includes exhaust cooling water passages defined in the inner housing and being fluidly connected to the inner housing cooling water passages, the exhaust cooling water passages surrounding at least a portion of the high rise exhaust passage.

In some implementations, the cooling system includes at least one conduit fluidly connected to the inner housing cooling water passages for providing cooling water to at least one of an engine management module, a fuel injector assembly, a vapor separator assembly and a power steering system of the marine engine assembly.

In some implementations, the at least one conduit provides cooling water to the engine management module, the vapor separator assembly and the power steering system of the marine engine assembly.

In some implementations, the inner housing defines at least one water discharge passage fluidly connected to a gearcase discharge passage defined in the gearcase.

In some implementations, the marine engine assembly further includes a steering actuator connected to the front wall of the outer housing, and a trim actuator connected to the front wall of the outer housing.

For purposes of this application, terms related to spatial orientation such as forward, rearward, upward, downward, left, and right, should be understood in a frame of reference of the marine engine assembly, as it would be mounted to a watercraft with in a neutral trim position. Terms related to spatial orientation when describing or referring to components or sub-assemblies of the engine assembly separately therefrom should be understood as they would be understood when these components or sub-assemblies are mounted in the marine engine assembly, unless specified otherwise in this application.

Explanations and/or definitions of terms provided in the present application take precedence over explanations and/or definitions of these or similar terms that may be found in any documents incorporated herein by reference.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementation of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

It should be noted that the Figures are not necessarily drawn to scale.

DETAILED DESCRIPTION

The present technology is described with reference to its use in a marine engine assembly 100 that is used to propel a watercraft and is configured to be disposed under the deck of the watercraft it propels. It is contemplated that the marine engine assembly 100 may be disposed at a transom of a watercraft, but not beneath its deck and that aspects of the present technology could be used in other types of marine engine assemblies, such as in a marine outboard motors having a midsection connected below the engine, a gearcase connected below the midsection, and a transom bracket configured to connect the midsection to a watercraft.

Figure 1:
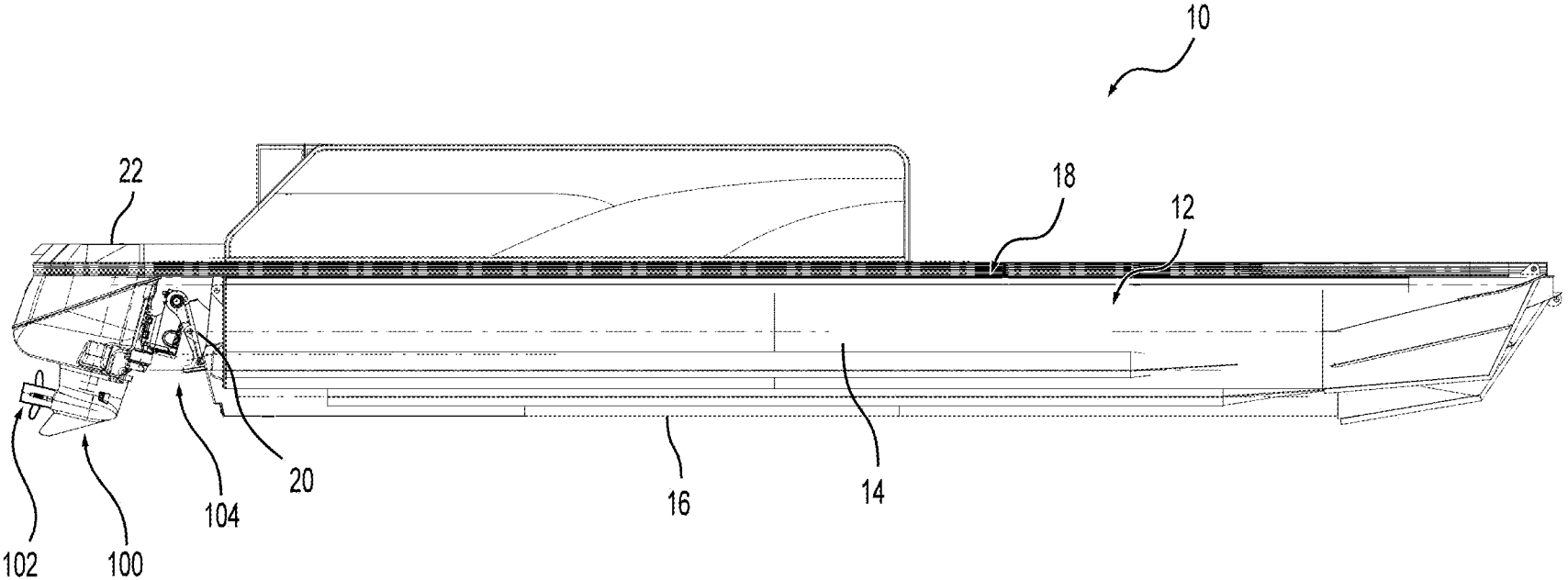
FIG. 1 is a right side elevation view of a watercraft having a marine engine assembly according to the present technology.

In FIG. 1, a watercraft 10 is illustrated. The watercraft 10 illustrated is a pontoon boat 10, but this is one non-limiting example of a watercraft according to the present technology and other types of watercraft are contemplated. This particular implementation of the boat 10 includes a watercraft body 12 formed generally from two side pontoons 14 (only one being illustrated), a central pontoon 16 and a platform 18.

The boat 10 also includes a marine engine assembly 100, also referred to herein as the assembly 100. The assembly 100 is pivotably and rotatably connected to the watercraft body 12 for providing propulsion via a propulsion device 102. The propulsion device 102 is a propeller 102 in the present implementation, but it is contemplated that the propulsion device 102 could be different in alternative implementations. For example, it is contemplated that the propulsion device 102 could be an impeller of a marine jet propulsion device or another type of propeller, such as a ducted propeller.

The assembly 100 includes a transom bracket 104 which is fastened to the watercraft body 12. The transom bracket 104 is connected to a transom 20 of the central pontoon 16, such that the assembly 100 is generally disposed below a top surface 22, also called the deck 22, of the platform 18 laterally between the pontoons 14.

With reference to FIGS. 2 to 8, the marine engine assembly 100, shown separately from the watercraft 10, will now be described. The assembly 100 includes the propeller 102, the transom bracket 104, a housing 106, an internal combustion engine 108, a driveshaft assembly 110 and other components disposed in the housing 106, some of which will be described in more details below.

The housing 106 supports and covers components disposed therein. The housing 106 includes an outer housing 112, an inner housing 114, a cover 116 and a gearcase 118. The outer housing 112 has a front wall **112*a* (FIG. 6). The cover 116 is removably connected to the outer housing 112 along a diagonally extending parting line 120 extending rearward of the front wall 112*a*. In the present implementation, the cover 116 is connected to the outer housing 112 using fasteners, but other types of connections, such as clamps or latches are contemplated. A seal 121 (FIG. 5) is provided between the cover 116 and the outer housing 112 along the parting line 120. The cover 116 and the outer housing 112 define a volume 116*a* therebetween (FIGS. 3 and 5**).

Figure 5:
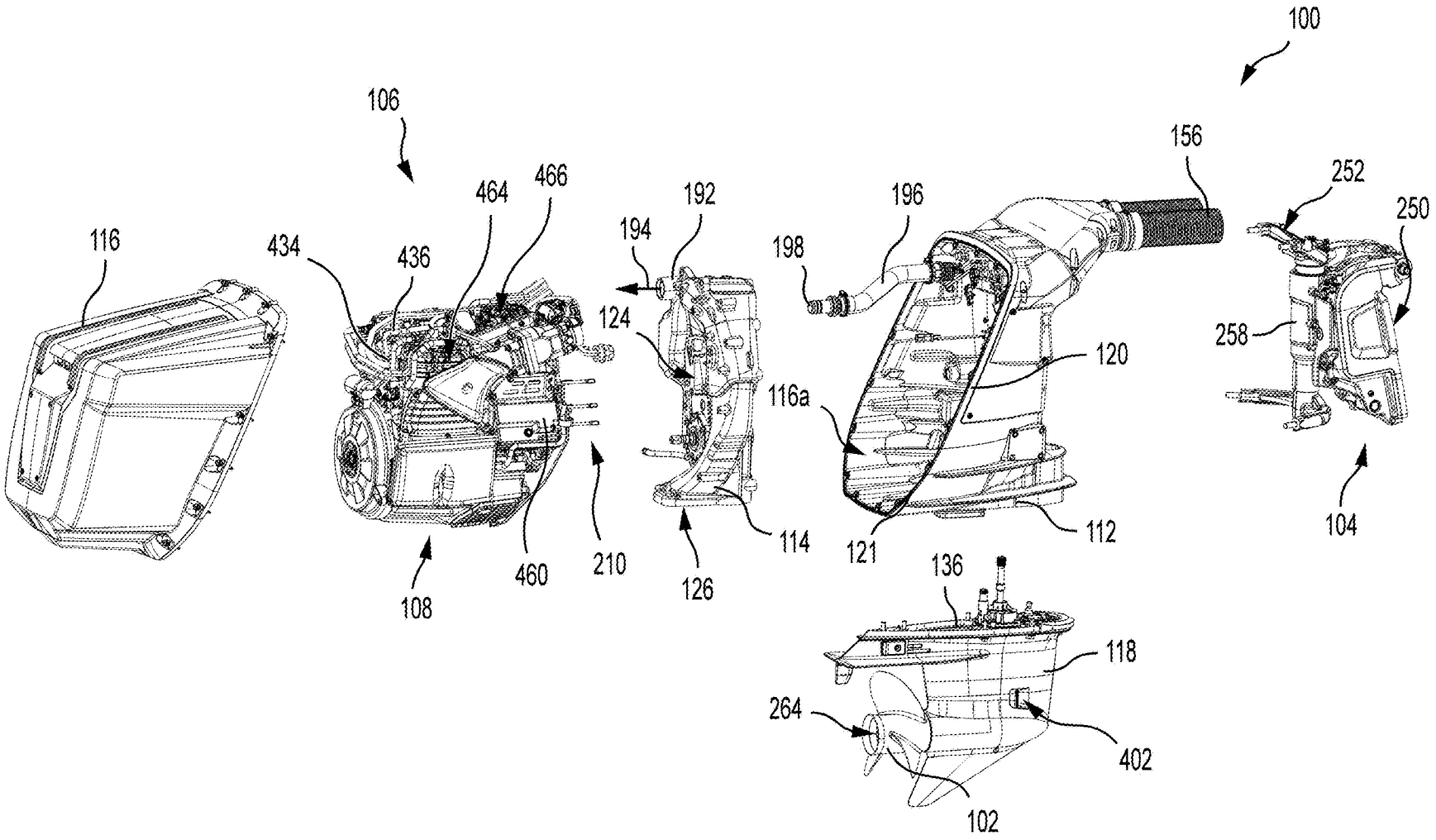
FIG. 5 is an exploded, perspective view taken from a top, rear, right side of the marine engine assembly of FIG. 2.
Figure 6:
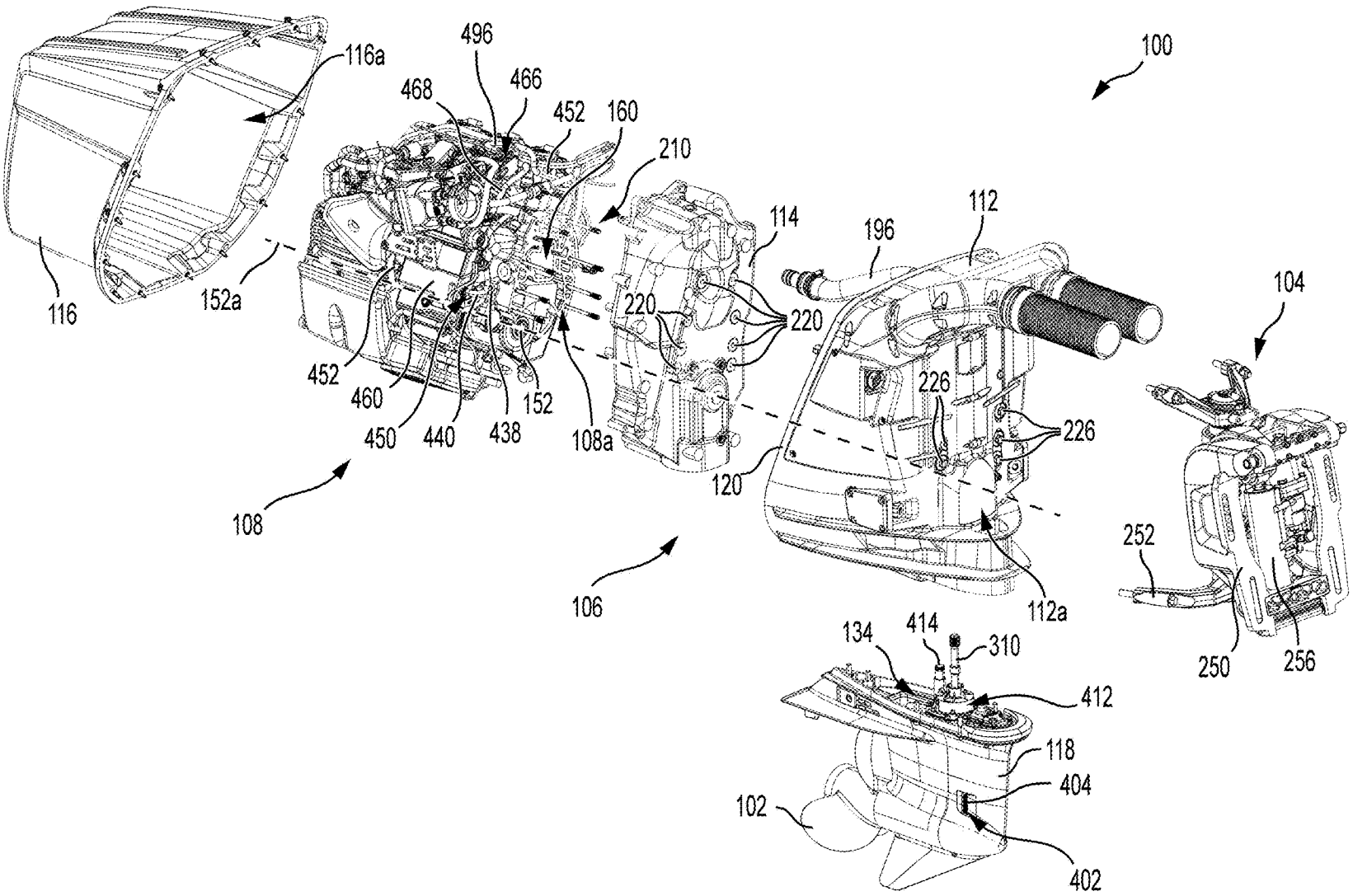
FIG. 6 is an exploded, perspective view taken from atop, front, right side of the components shown in FIG. 5.

As best seen in FIGS. 5 and 6, the inner housing 114 is disposed in the outer housing 112 and is therefore housed in the volume **116*a* defined between the cover 116 and the outer housing 112. The inner housing 114 is connected to the outer housing 112 by a plurality of housing fasteners 200*a*, 200*b* which will be described in more detail below. The inner housing 114 is disposed in part between a front face 108*a* of the engine 108 and the front wall 112*a* of the outer housing 112. The front face 108*a* of the engine 108 is connected to a back face of the inner housing 114 and is supported by the inner housing 114 by a plurality of engine fasteners 210 which will also be described in more detail below. It is to be noted that the housing fasteners 200*a*, 200*b* are disposed at different positions than the engine fasteners 210**.

Figure 3:
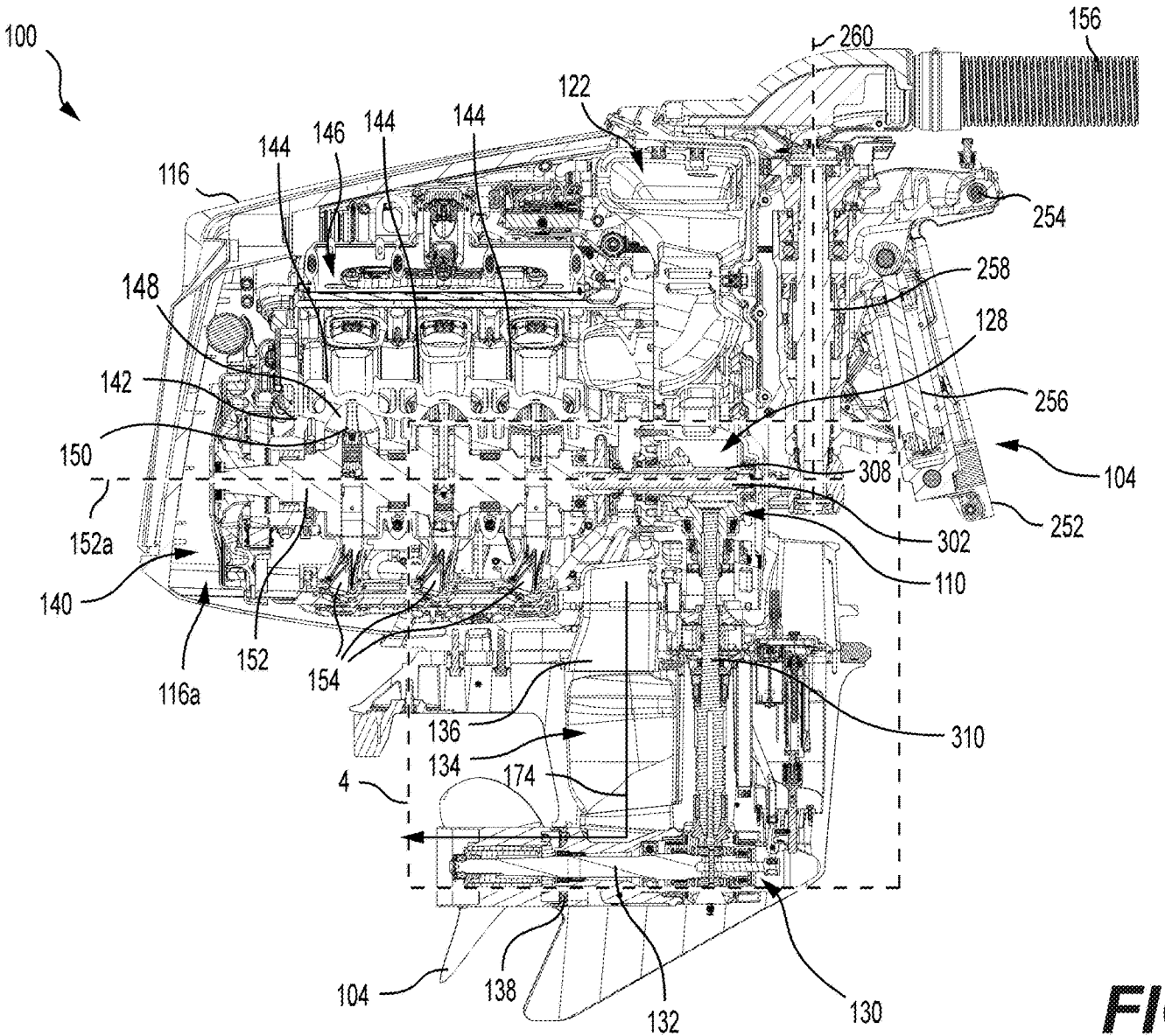
FIG. 3 is a vertical cross-sectional view of the marine engine assembly of FIG. 2, the vertical cross-section being taken longitudinally along a lateral center of the marine engine assembly.

When the marine engine assembly 100 is assembled as shown in FIG. 3, the engine 108 is housed in the volume **116*a* defined between the cover 116 and the outer housing 112. By removing the cover 116, the engine 108 can be accessed. The inner housing 114 defines a high rise exhaust passage 122 (FIG. 15) having an inlet 124 (FIG. 8) fluidly communicating with exhaust outlets 124*a* (FIG. 14) of the engine 108 through an exhaust manifold 160 (FIG. 10), and a downward facing outlet 126 (FIGS. 15 and 19) at a bottom thereof that fluidly communicates with the gearcase 118. The inner housing 114 also defines a chamber 128 (FIG. 4) that contains lubricant (not shown) and that houses a portion of the driveshaft assembly 110**.

Referring to FIGS. 2 to 6, the gearcase 118 is connected to a lower portion of the outer housing 112. The gearcase 118 houses a transmission 130 operatively connected to the driveshaft assembly 110, and a propulsion shaft 132 selectively driven by the transmission 130. The propulsion shaft 132 is connected to and drives the propeller 102. As in the present implementation the propulsion shaft 132 drives the propeller 102, it can also be referred to as a propeller shaft 132. The gearcase 118 also defines an exhaust passage 134 having an inlet 136 at a top thereof and an outlet 138 at a rear thereof.

In the present implementation, the outer and inner housings 112, 114 are cast metal parts, but other materials and manufacturing methods are contemplated. The cover 116 is made from a composite material, such as a glass fiber and thermoset or thermoplastic resin composite, and the gearcase 118 is made from cast aluminum, but other materials are contemplated.

Figure 4:
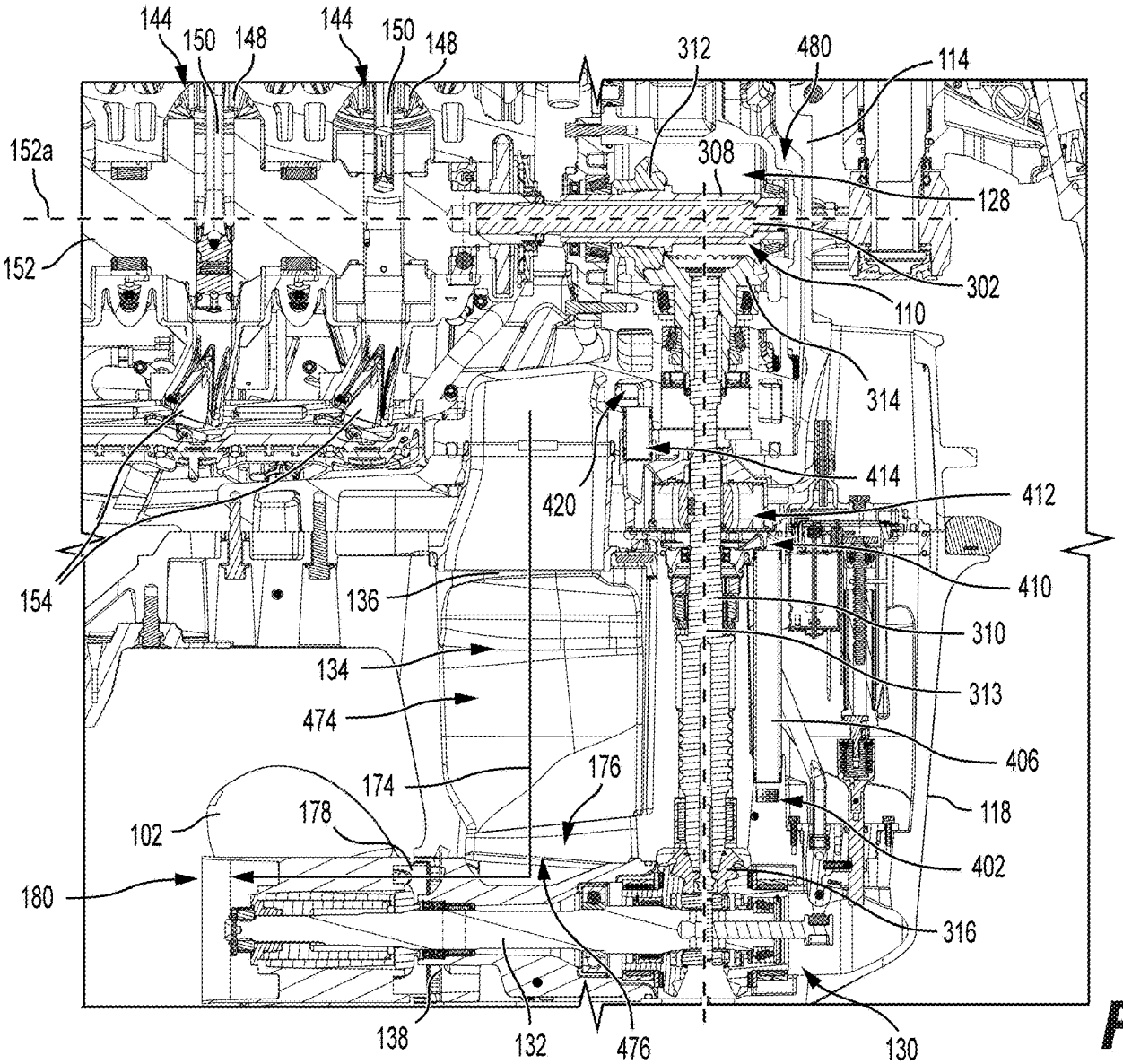
FIG. 4 is a close-up of portion 4 of FIG. 3.

With reference to FIGS. 3, 4, 14 and 17, the engine 108 will be briefly described. In the present implementation, the internal combustion engine 108 is a three-cylinder, twostroke, gasoline-powered, direct injected internal combustion engine. It is contemplated that the internal combustion engine 108 could be a four-stroke internal combustion engine. It is contemplated that the engine 108 could have more or less than three cylinders. In some implementations, the internal combustion engine 108 could use a fuel other than gasoline, such as diesel. The internal combustion engine 108 includes a crankcase 140. A cylinder block 142 defining three cylinders 144 is disposed above the crankcase 140. A cylinder head 146 is disposed on top of the cylinder block 142. Each cylinder 144 has a piston 148 (FIG. 14) reciprocally received inside of it. Each piston 148 is connected by a corresponding connecting rod 150 to a crankshaft 152. The crankshaft 152 rotates in the crankcase 140 about a crankshaft axis 152*a* (FIGS. 3 and 4). As best seen in FIG. 6, the crankshaft axis 152*a* intersects the front wall 112*a* of the outer housing 112. For each cylinder 144, the piston 148, the cylinder 144 and the cylinder head 146 define together a combustion chamber. For each combustion chamber, a direct fuel injector 147 supported by the cylinder head 146 is provided to inject fuel into the combustion chamber, and a spark plug 149 extends into the combustion chamber through the cylinder head 146 to ignite an air-fuel mixture inside the combustion chamber. During operation of the engine 108, the reciprocation of the pistons 148 causes the crankshaft 152 to rotate about the crankshaft axis 152*a*. The crankshaft 152 drives the driveshaft assembly 110, which drives the transmission 130, which drives the propeller shaft 132, which drives the propeller 102. As can be seen in FIG. 3, in the present implementation the crankshaft 152 and the propeller shaft 132 are parallel to each other.

Figure 14:
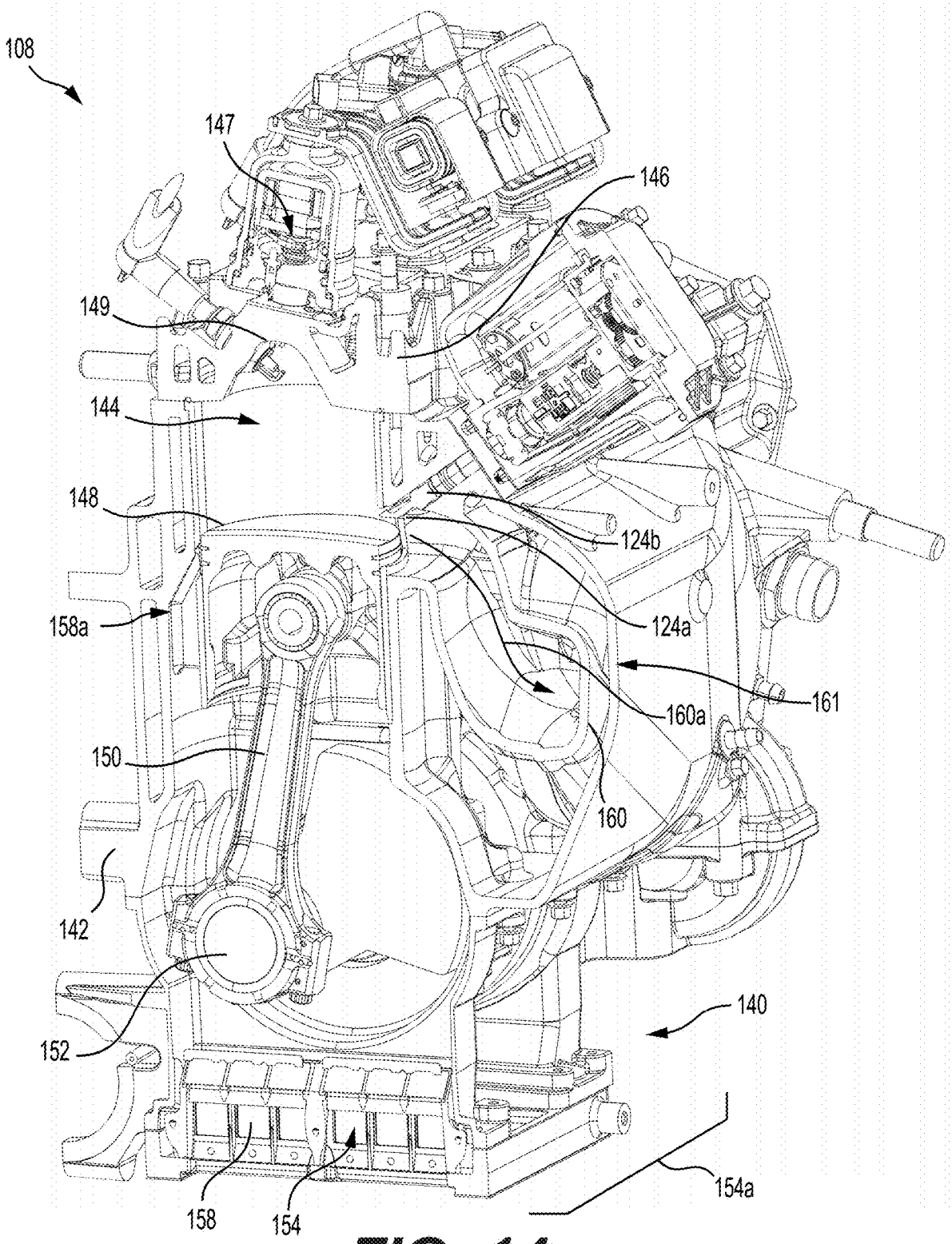
FIG. 14 is a perspective view taken from a rear, right side of a vertical cross-section of an engine, an exhaust system and other components of the marine engine assembly of FIG. 2, the vertical cross-section being taken laterally through a center of a middle cylinder of the engine.

Referring to FIGS. 3, 4 and 14, the engine 108 includes one air intake 154 per cylinder 144. The air intakes 154 are provided at the bottom of the crankcase 140. Air is delivered to the air intakes 154 by an air intake assembly as indicated by arrow 154*a* (FIG. 14). Air is supplied to the air intake assembly by an air intake hose 156 (FIGS. 3 and 5). The air passes through reed valves 158 provided in the crankcase 140 adjacent the air intakes 154. The reed valves 158 allow air to enter the crankcase 140 but prevent air from exiting the crankcase 140. For each cylinder 144, a transfer port 158*a* communicates the crankcase 140 with the corresponding combustion chamber for air to be supplied to the combustion chamber.

Referring to FIG. 14, each combustion chamber has a corresponding exhaust outlet 124*a*. Exhaust gases flow from the combustion chambers, through the exhaust outlets 124*a*, into the exhaust manifold 160 as indicated by arrow 160*a*. Each exhaust outlet 124*a* has a corresponding reciprocating exhaust valve 124*b* that varies the effective cross-sectional area and timing of its exhaust outlet 124*a*. An exhaust system 161 that includes the exhaust manifold 160, the high rise exhaust passage 122, and the exhaust passage 134 defined in the gearcase 118 will now be briefly described. During operation, exhaust gases flow from the exhaust outlets 124*a* of the engine 108 into the exhaust manifold 160, then into the high rise exhaust passage 122 of the inner housing 114 via the inlet 124, then flows out of the exhaust passage 122 via the outlet 126 into the exhaust passage 134 of the gearcase 118 via the inlet 136, then out of the exhaust passage 134 into the propeller 102 via the outlet 138. More particularly and with reference to FIGS. 3 and 4, as indicated by arrow 174, the exhaust gases flow through the exhaust passage 134, then through channels 176, and finally through passages 178 defined in the propeller 102. The ends of the passages 178 define the exhaust gas outlets 180 of the exhaust system 161. At least a portion of the exhaust gas are routed out of the marine engine assembly 100 through the propeller 102 as described above.

Figure 15:
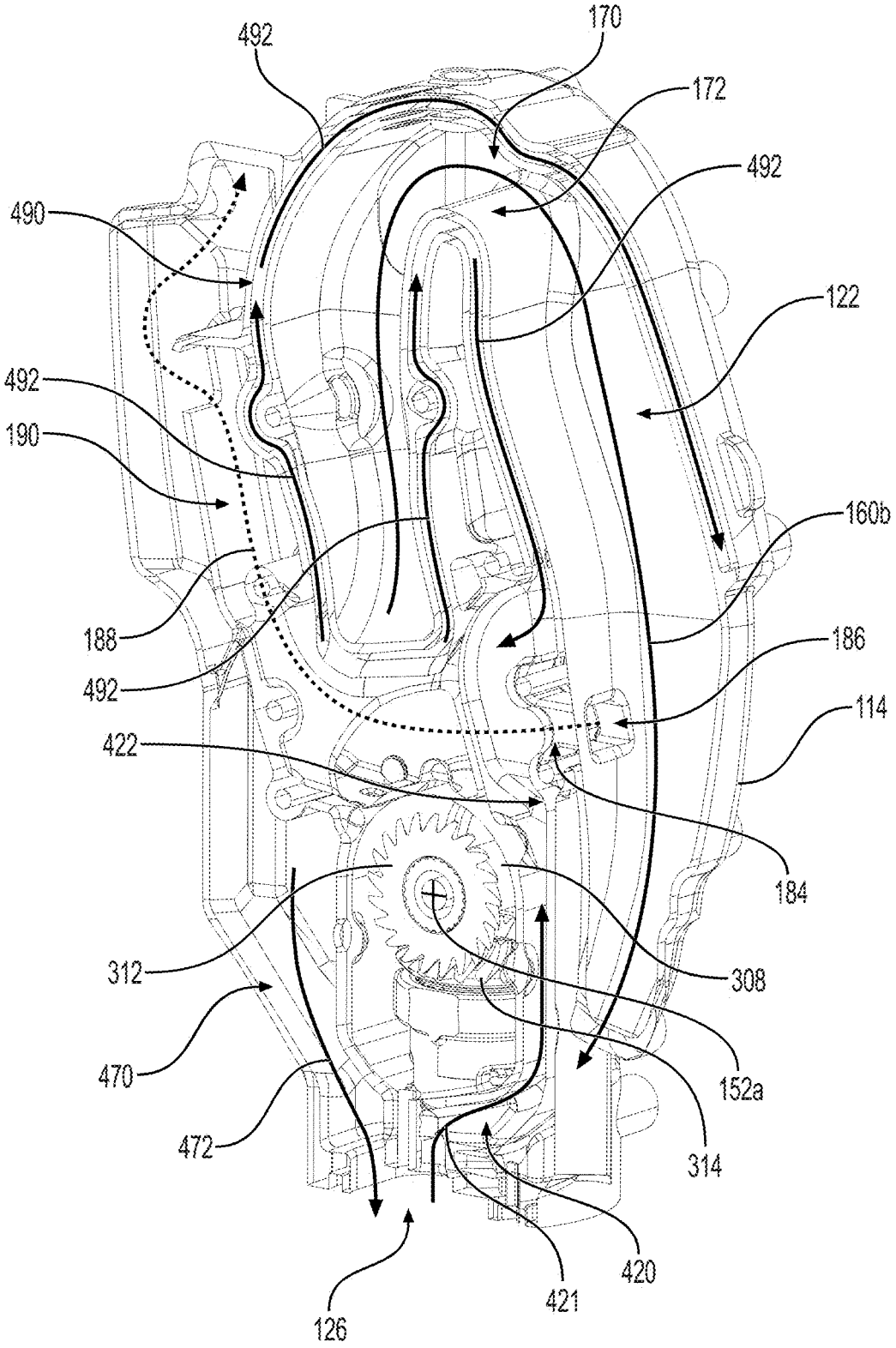
FIG. 15 is a perspective view taken from a rear, right side of a vertical cross-section of the inner housing of FIG. 7 taken through line 15-15 of FIG. 7.
Figure 16:
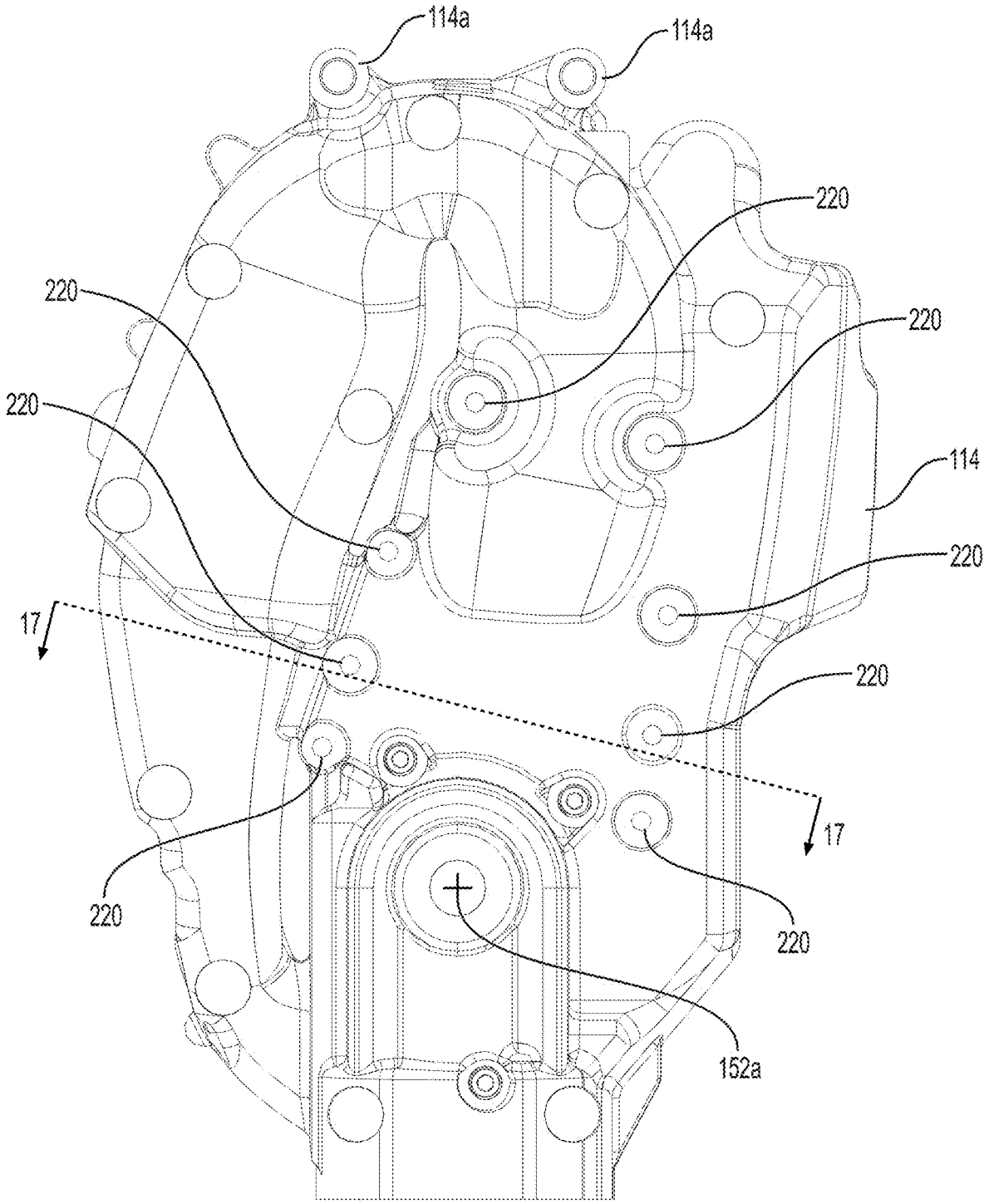
FIG. 16 is a front elevation view of the inner housing of FIG. 7, with a cylinder block of an engine connected thereto.

As can be seen in FIG. 15, the high rise exhaust passage 122 extends upward, then curves and extends downward, thus forming a gooseneck having an apex 170. Exhaust gases flow in the exhaust passage 122 in the direction indicated by arrow 160*b*. The inner portion 172 of the apex 170 is vertically higher than the top of the combustion chambers when the marine engine assembly 100 is in the trim range to help prevent intrusion of water into the combustion chambers from the exhaust system 161. From the apex 170 of the exhaust passage 122, the exhaust gases flow downward.

Figure 18:
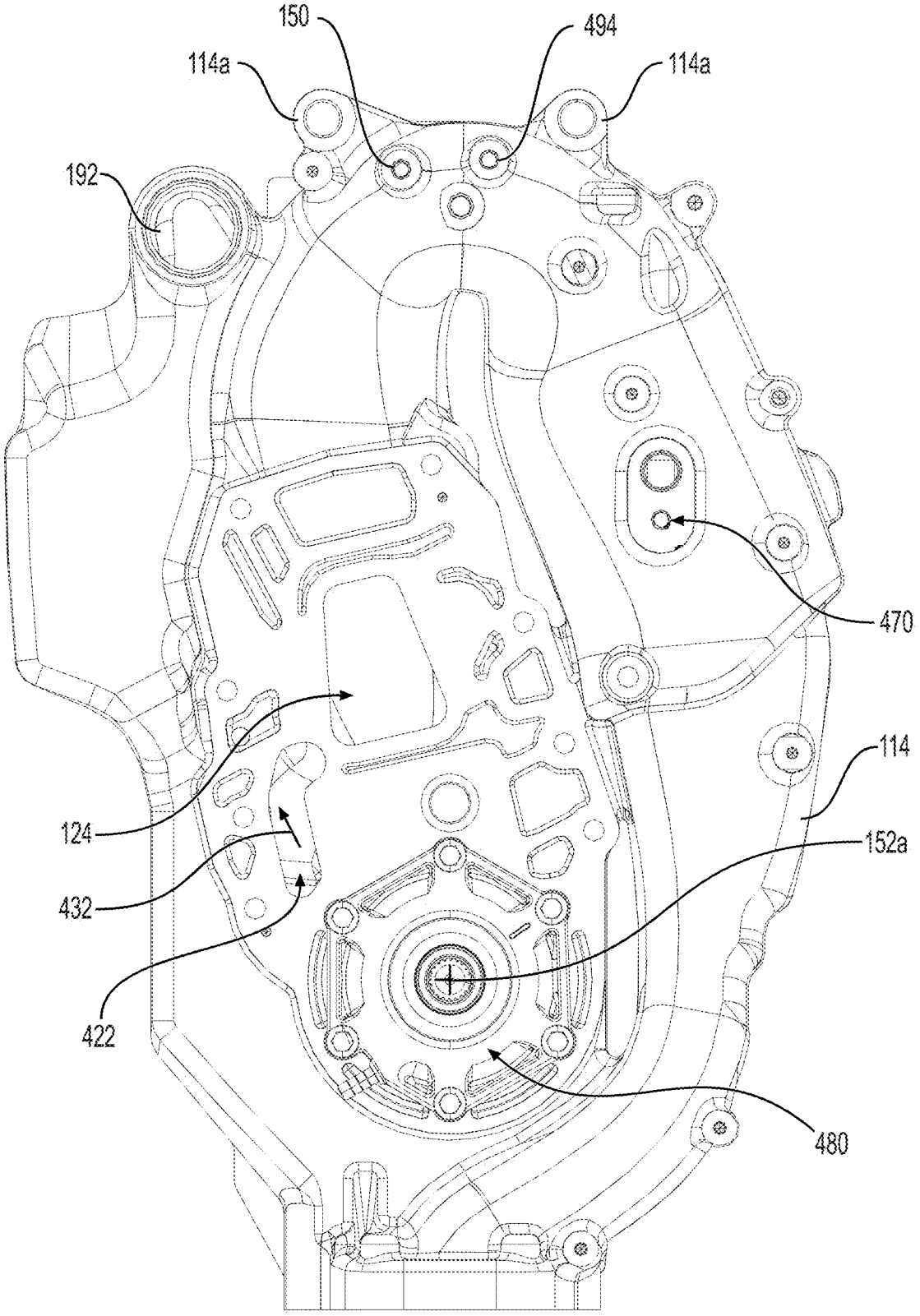
FIG. 18 is a rear elevation view of the inner housing of FIG. 7.

During operation of the marine engine assembly 100, such as when the engine 108 is idling or operating at trolling speeds, the exhaust gas pressure may become too low to keep the water out of the lower portion of the exhaust system 161. Under these conditions, water can enter the passages 178, the channels 176, the exhaust passage 134, and rise into the exhaust passage 122 up to the same level as the water outside of the marine engine assembly 100 (i.e. up to the waterline). As this water blocks the exhaust outlets 180, the exhaust system 161 includes an idle relief exhaust system 184 (FIG. 15) to allow the exhaust gases to flow out of the marine engine assembly 100 to the atmosphere. With reference to FIG. 15, the idle relief exhaust system 184 has an idle relief passage inlet 186 fluidly communicating with the exhaust passage 122. The idle relief passage inlet 186 is fluidly connected to the exhaust passage 122 between the inlet 124 (FIG. 18) and the outlet 126 thereof. As indicated by the dotted-line arrow 188, from the idle relief passage inlet 186 the exhaust gases flow left trough a passage, then through a tortuous passage 190. With reference to FIG. 5, from a top of the tortuous passage 190, the exhaust gases flow rearward through an idle relief muffler 192 disposed on top of the inner housing 114 as indicated by arrow 194. From the idle relief muffler 192, the exhaust gases flow through a pipe 196 that extends through a rear of the cover 116. The outlet of the pipe 196 is an idle relief passage outlet 198 of the idle relief exhaust system 184. The idle relief passage outlet 198 is near a top of the housing 106 so as to be above the waterline during typical operation of the marine engine assembly 100. It is contemplated that the idle relief passage outlet 198 could be disposed on the front, top or sides of the housing 106. It is contemplated that the idle relief passage outlet 198 could be located at other positions that are vertically higher than the exhaust gas outlets 180 at least when the marine engine assembly 100 is in the trim range.

Figure 7:
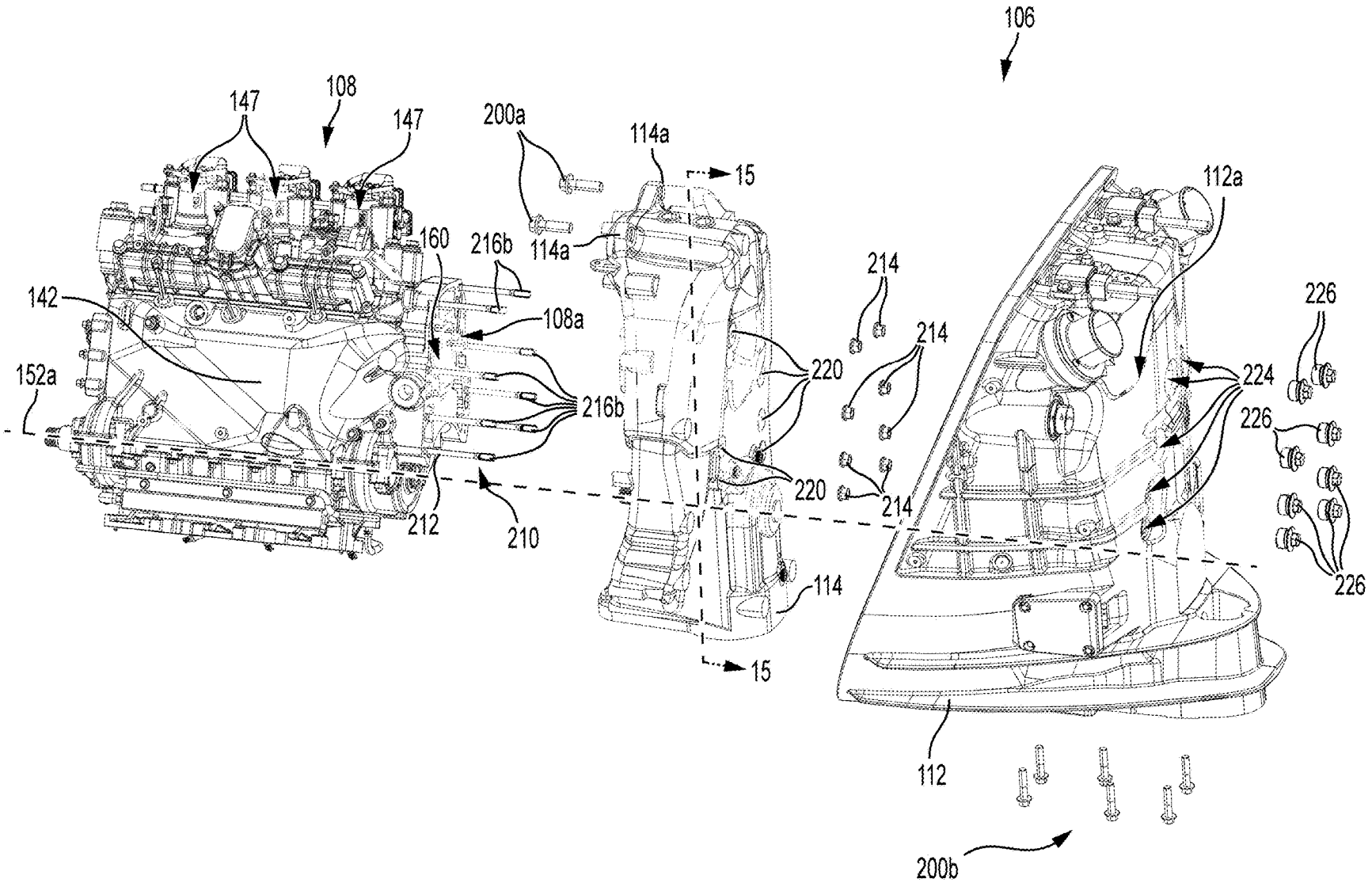
FIG. 7 is an exploded, perspective view taken from a top, front, right side of an engine, an inner housing and an outer housing of the marine engine assembly of FIG. 5, with a plurality of engine fasteners and a plurality of housing fasteners.
Figure 8:
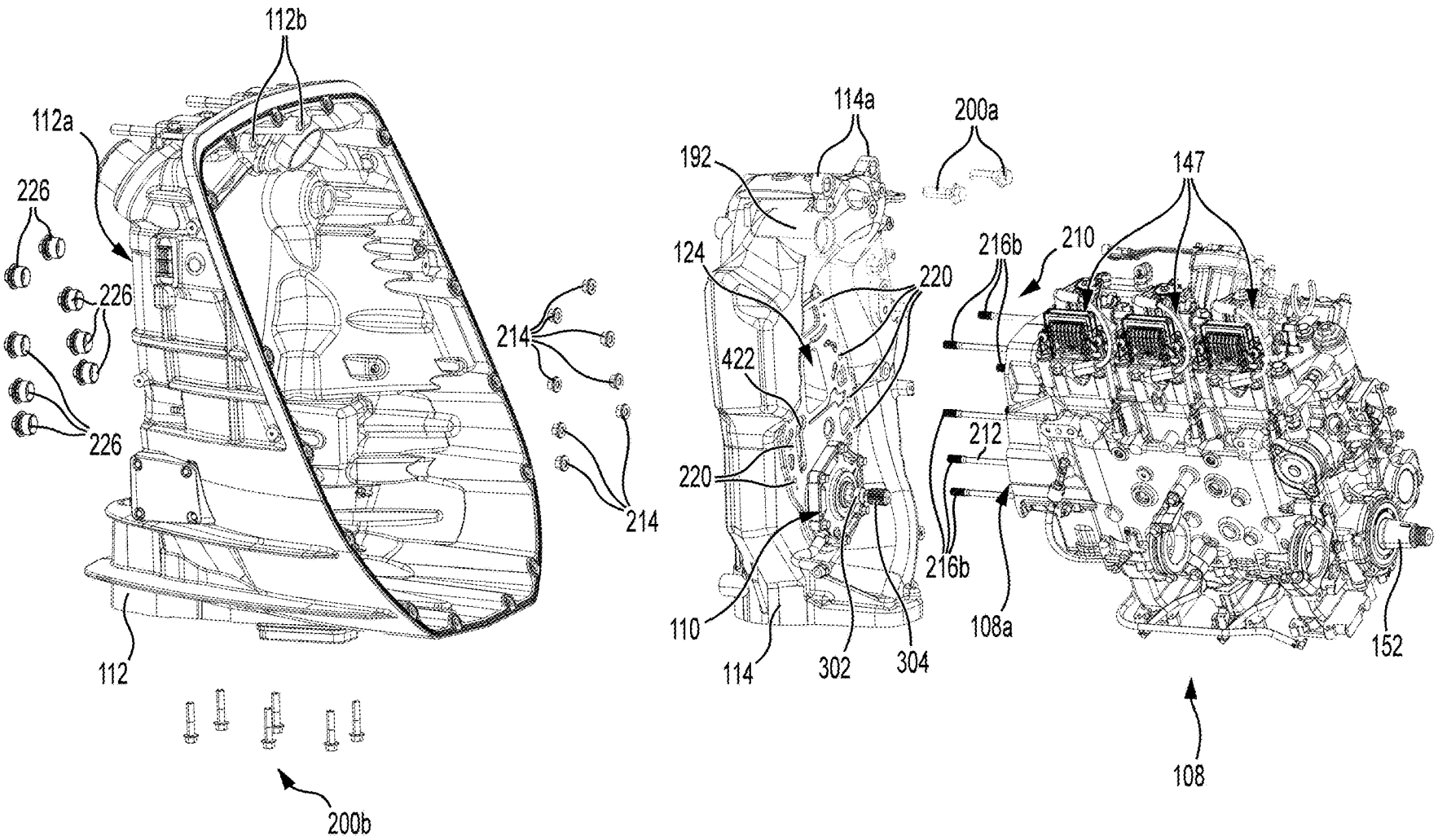
FIG. 8 is an exploded, perspective view taken from a top, rear, left side of the components shown in FIG. 7.
Figure 9:
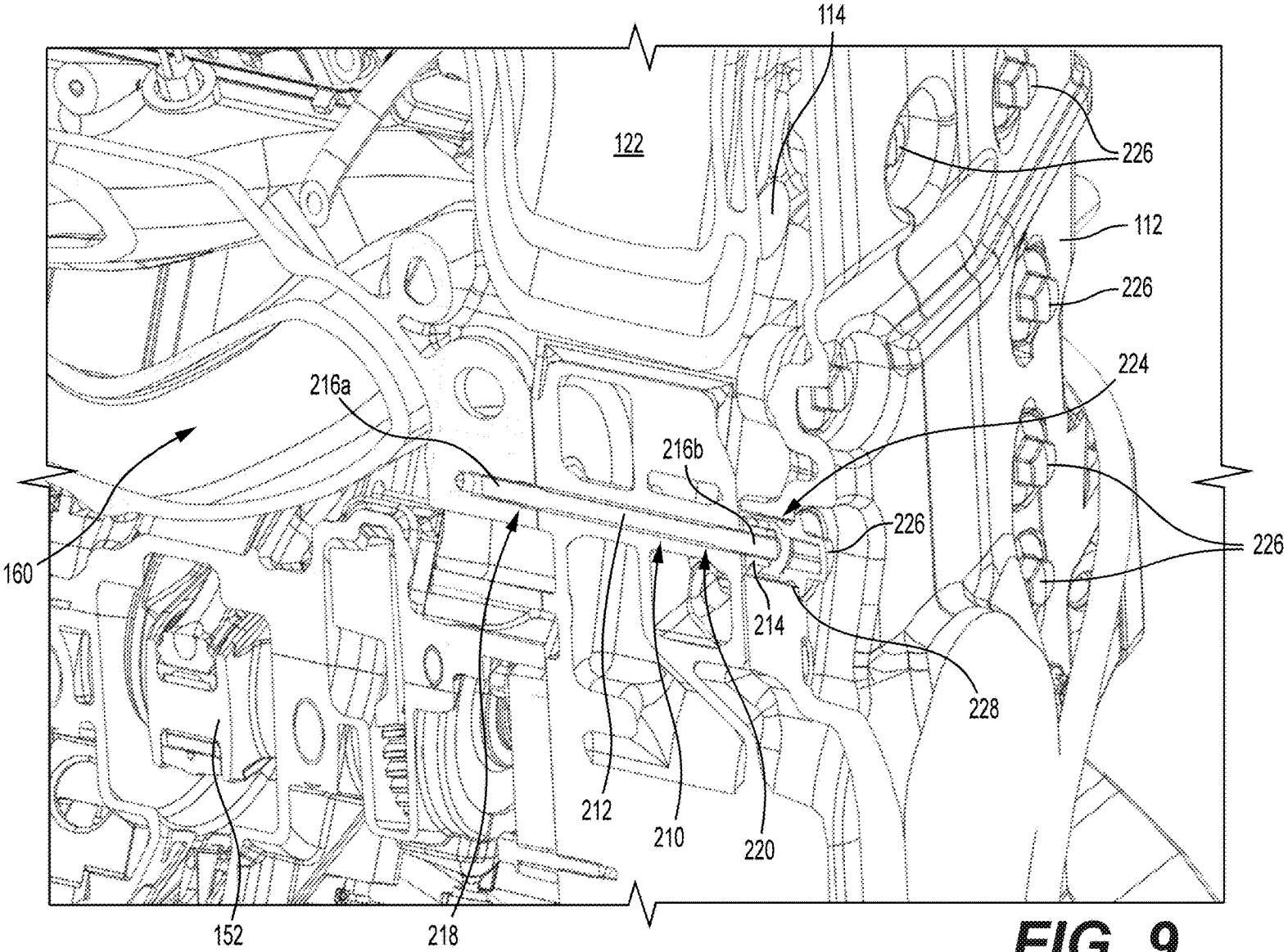
FIG. 9 is a close-up perspective view of a portion of a vertical and longitudinal cross-section of the marine engine assembly of FIG. 2 extending through one of the engine fasteners of FIG. 7.
Figure 10:
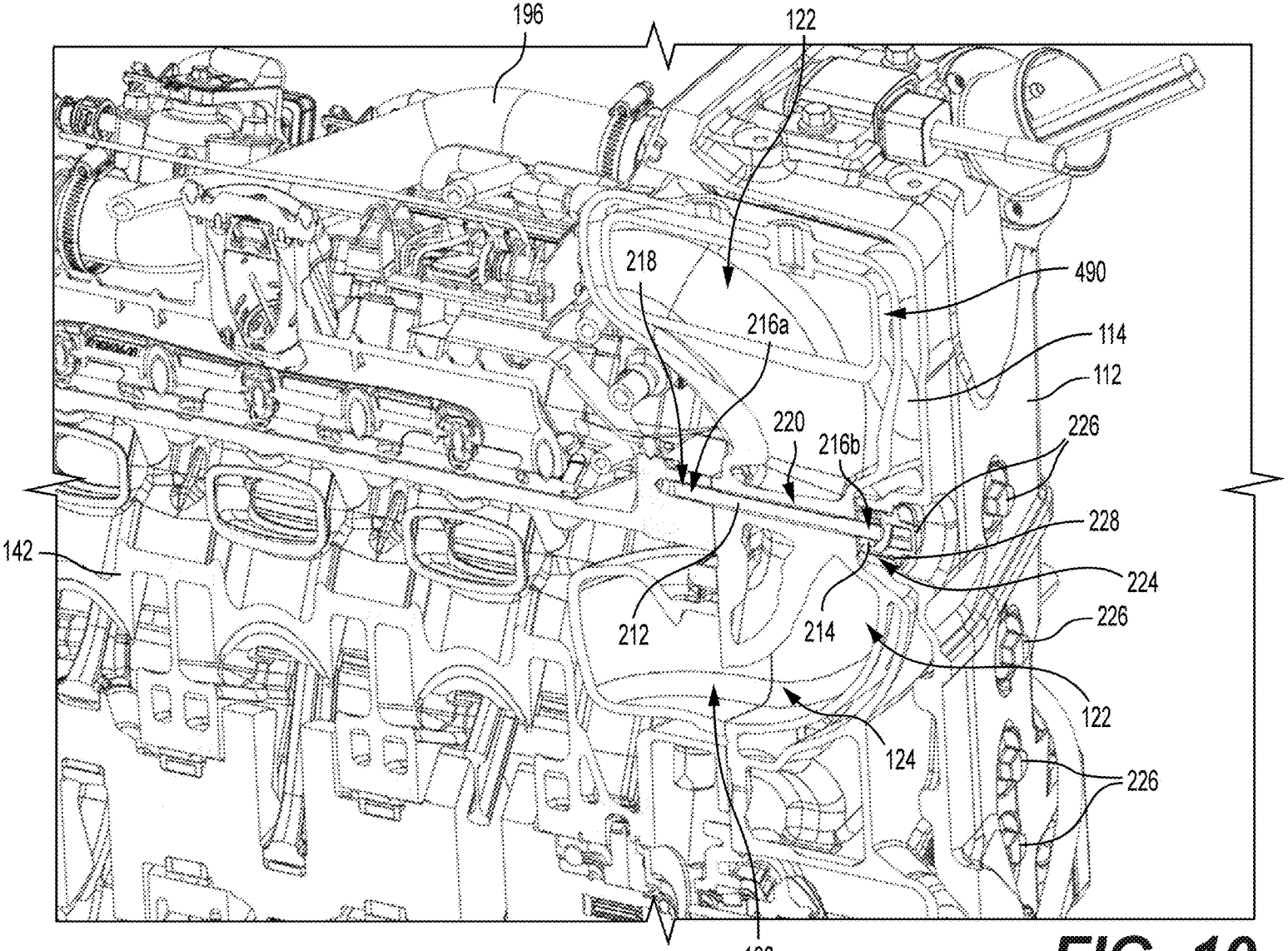
FIG. 10 is a close-up perspective view of a portion of a vertical and longitudinal cross-section of the marine engine assembly of FIG. 2 extending through another one of the engine fasteners of FIG. 7.
Figure 11:
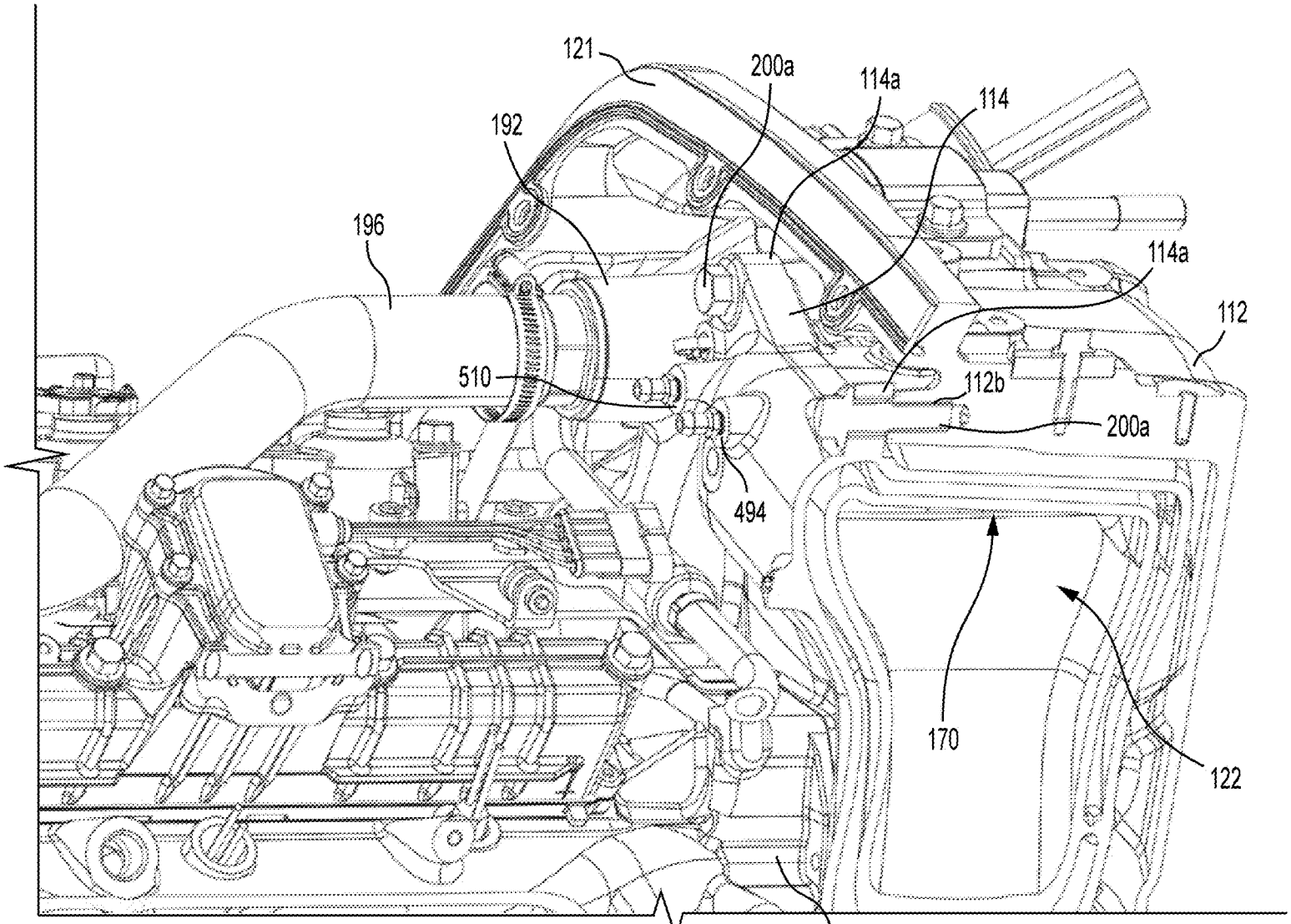
FIG. 11 is a close-up perspective view of a portion of a vertical and longitudinal cross-section of the marine engine assembly of FIG. 2 extending through one of the housing fasteners of FIG. 7.
Figure 12:
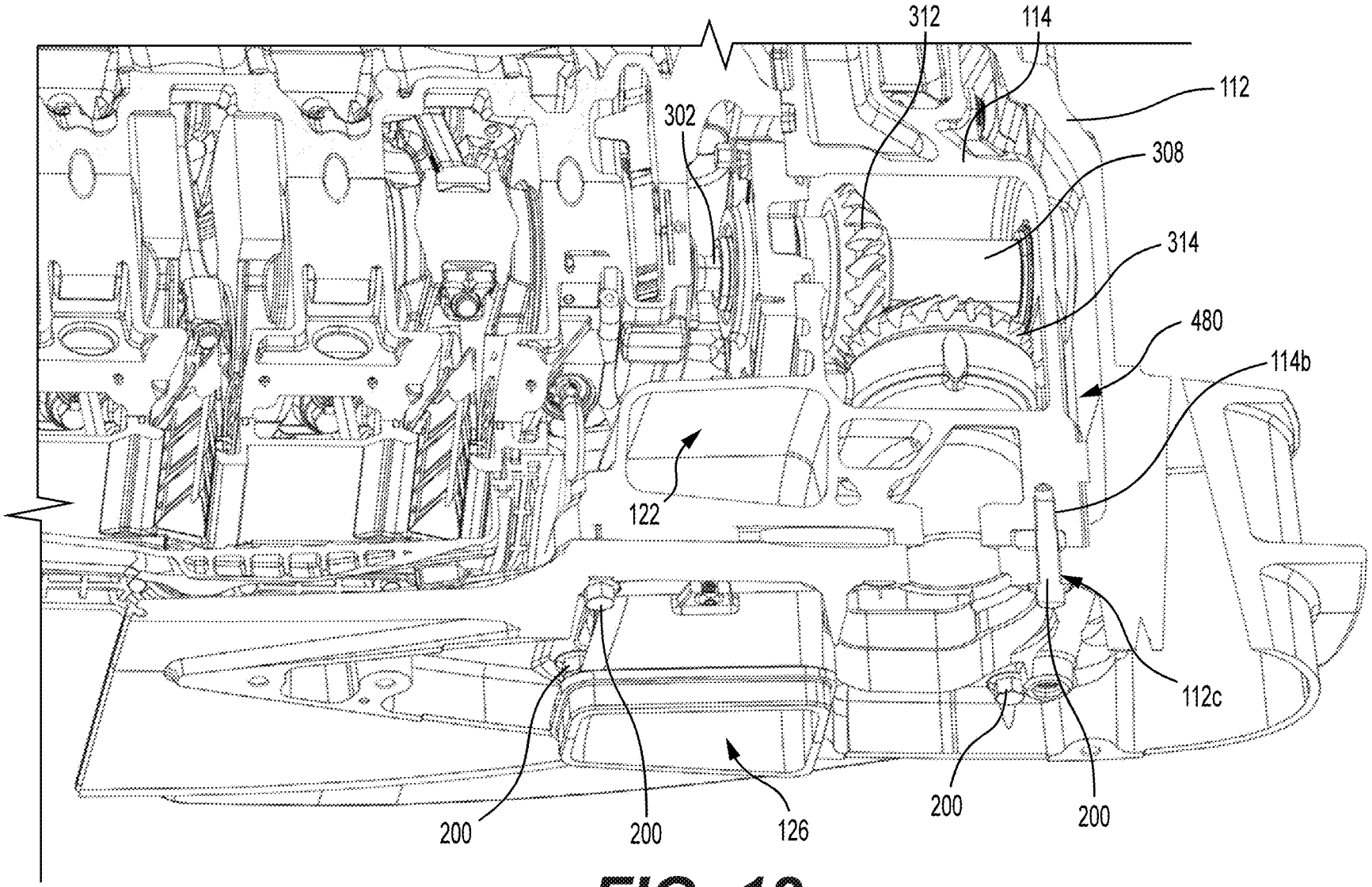
FIG. 12 is a close-up perspective view of a portion of a vertical and longitudinal cross-section of the marine engine assembly of FIG. 2 extending through another one of the housing fasteners of FIG. 7.

Turning now to FIGS. 7 to 12, the connection of the inner housing 114 to the outer housing 112 using the housing fasteners 200*a*, 200*b* will be described in more details. The inner housing 114 defines two flanges 114*a* in an upper portion thereof. To connect the upper portion of the inner housing 114 to the upper portion of the outer housing 112, two housing fasteners 200*a* extend through respective flanges 114*a* and through the back face of the outer housing 112. The housing fasteners 200*a* are threaded fasteners engaging threaded boreholes 112*b* defined in the outer housing 112 (FIGS. 8 and 11). The housing fasteners 200*a* extend parallel to the crankshaft axis 152*a*, but could be oriented otherwise in other implementations. It is contemplated that in other implementations, the housing fasteners 200*a* could differ from threaded fasteners, and that more or less than two housing fasteners 200*a* could be used to connect the upper portions of the inner housing 114 and the outer housing 112 together.

Figure 19:
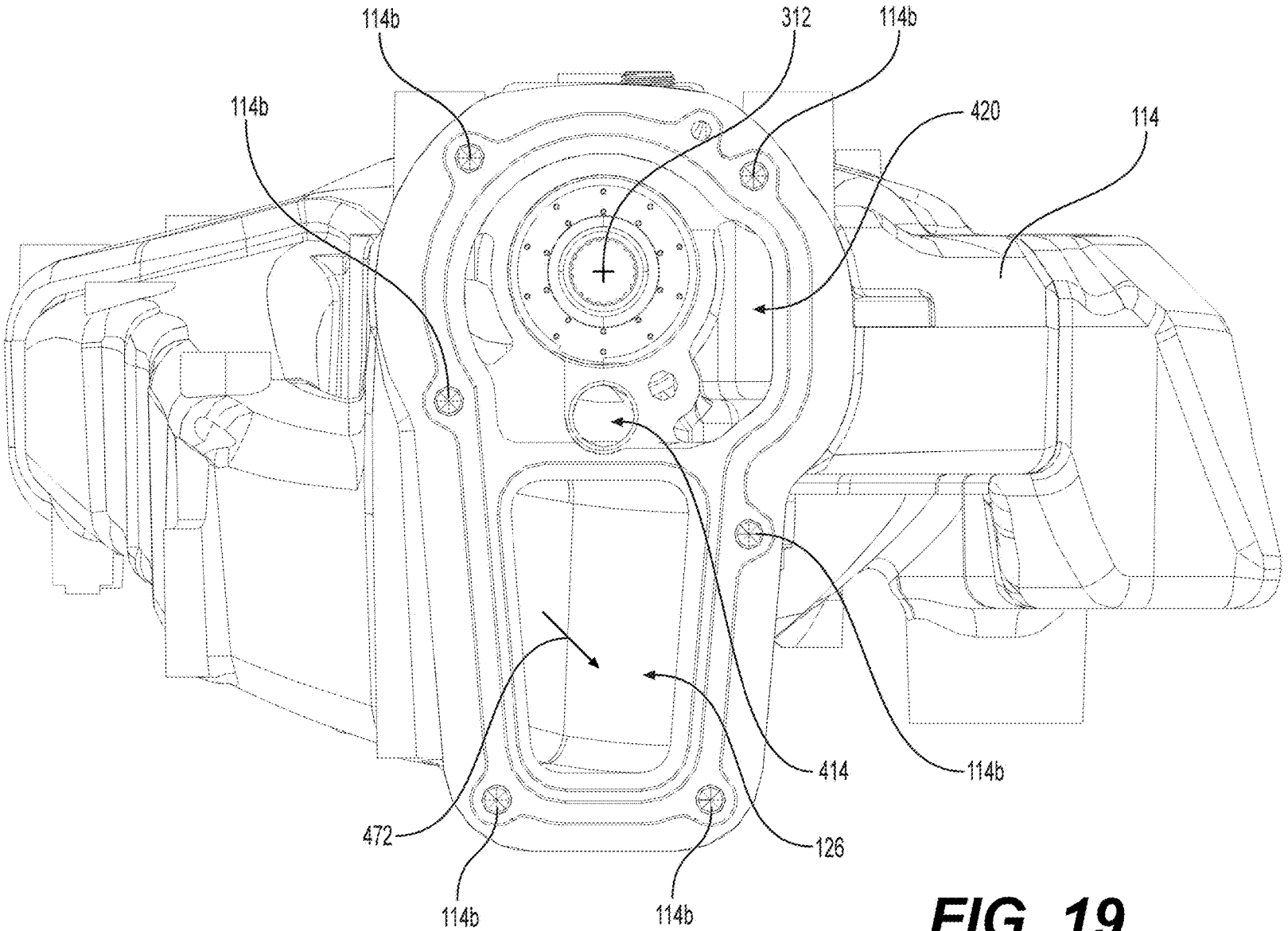
FIG. 19 is a bottom plan view of the inner housing of FIG. 7.

Still referring to FIGS. 7 to 12, to connect the lower portion of the inner housing 114 to the lower portion of the outer housing 112, six housing fasteners 200*b* extend upward through apertures 112*c* (FIG. 12) defined in the lower portion of the outer housing 112 and into threaded holes 114*b* defined in the inner housing 114. The six threaded holes 114*b* are best seen in FIG. 19. It is contemplated that more or less than six housing fasteners 200*b* could be used to connect the lower portion of the inner housing 114 to the lower portion of the outer housing 112. Referring to FIGS. 4 and 19, the six housing fasteners 200*b* are disposed around a driveshaft 310 of the driveshaft assembly 110 extending perpendicular to the crankshaft axis 152*a*. The six housing fasteners 200*b* extend parallel to the driveshaft 310, but could be oriented otherwise in other implementations. The six housing fasteners 200*b* are also disposed around the exhaust outlet 126.

Referring now to FIGS. 5 to 10, the connection of the engine 108 to the inner housing 114 using the engine fasteners 210 will be described in more details. In the present implementation, eight engine fasteners 210 are used to connect the engine 108 to the inner housing 114, but it is contemplated that more or less than eight engine fasteners 210 could be used in other implementations. As best seen in FIGS. 9 and 10, each engine fastener 210 includes a shaft 212 connected to the engine 108 and extending forwardly therefrom, and a corresponding nut 214. The shaft 212 has threaded rear and front ends 216*a*, 216*b*. The rear end 216*a* threadingly engages a threaded hole 218 defined in the front face 108*a* of the engine 108, and the front end 216*b* is configured for threadingly engaging the corresponding nut 214. The shaft 212 extends through a corresponding hole 220 defined in the inner housing 114. When the nut 214 is tightened on the front end 216*b*, the inner housing 114 is retained and pressed against the front face 108*a* of the engine 108. The front wall 112*a* of the outer housing 112 defines eight apertures 224 being at least partially aligned with the holes 220 and the nuts 214 for granting access to the engine fasteners 210. A cap 226 is disposed in each one of the apertures 224. Each cap 226 is removably connected to the front wall 112*a* of the outer housing 112 for selectively granting access to the corresponding engine fastener 210. More particularly, each cap 226 has a thread configured for threadingly engaging a threaded surface defined in the corresponding aperture 224. The caps 226 could differ in other implementations (ex. press-fit plugs). An O-ring 228 (FIGS. 9 and 10) is disposed between each cap 226 and the front face 112*a* of the outer housing 112 for limiting the amount of water that could enter the marine engine assembly 100 through the apertures 224.

As best seen in FIGS. 6 and 7, the engine fasteners 210 extend above the crankshaft 152 and thus above the crankshaft axis 152*a*. It is contemplated that the engine fasteners 210 could be disposed around the crankshaft 152 and thus around the crankshaft axis 152*a* in other implementations. As best seen in FIG. 8, the engine fasteners 210 are also disposed around the inlet 124 and a cooling water outlet 422 defined in the inner housing 114. This positioning of the engine fasteners 210 ensures an adequate seal around the inlet 124 and the cooling water outlet 422 when the engine fasteners 210 are tightened. It is also to be noted that the housing fasteners 200*a* connecting the upper portion of the inner housing 114 to the upper portion of the outer housing 112 extend above the engine fasteners 210, and that the housing fasteners 200*b* connecting the lower portion of the inner housing 114 to the upper portion of the outer housing 112 extend below the engine fasteners 210.

The construction of the marine engine assembly 100 allows the engine 108 to not be directly connected to the outer housing 112, but rather indirectly connected thereto via the inner housing 114. Since the engine fasteners 210 do not engage the outer housing 112, there is a decoupling between the engine 108 and the transom bracket 104, which can assist in reducing transmission of noise, vibration and harshness of the marine engine assembly 100 to the boat 10. In addition, by mounting the engine 108 along its front face 108*a* rather than along a bottom face thereof to the outer housing 112, the bottom wall of the outer housing 112 can be kept thin and streamlined, which can assist in reducing drag of the marine engine assembly 100 and help the boat 10 get on plane.

With reference to FIGS. 2 to 6, the transom bracket 104 will be briefly described. The transom bracket 104 includes a watercraft portion 250 which is adapted for fastening to the watercraft body 12. The bracket 104 also includes an engine portion 252, pivotally connected to the watercraft portion 250, and which is fastened to the front wall 112*a* of the outer housing 112 at positions differing from the apertures 224. The engine portion 252 is pivotable with respect to the watercraft portion 250 about a tilt-trim axis 254. The transom bracket 104 thus defines the tilt-trim axis 254 of the marine engine assembly 100, about which the assembly 100 can be trimmed or tilted relative to the watercraft body 12. The engine portion 252 of the transom bracket 104 includes a tilt and trim actuator 256 (FIG. 3) for tilting or trimming the assembly 100 relative to watercraft body 12. It is contemplated that the actuator 256 could only trim the assembly 100, in which case the actuator 256 would be a trim actuator. In the present implementation, the tilt and trim actuator 256 is a linear hydraulic actuator adapted for pushing the engine portion 252 away from the watercraft portion 250, but other types of tilt and trim actuators 256 are contemplated, such as those described in United States Patent Application Publication No. 2019/0233073 A1, published on Aug. 1, 2019 and entitled "Stern and Swivel Bracket Assembly For Mounting A Drive Unit to a Watercraft", U.S. Pat. No. 7,736,206 B1, issued on Jun. 15, 2010 and entitled "Integrated Tilt/trim and Steering Subsystem For Marine Outboard Engines", and U.S. Pat. No. 9,499,247 B1, issued on Nov. 22, 2016 and entitled "Marine Outboard-Engine Having A Tilt/trim And Steering Bracket Assembly", the entirety of each of which is incorporated herein by reference. The engine portion 252 includes a steering actuator 258 configured for steering the housing 106, and therefore the propeller 102, relative to the transom bracket 104 about a steering axis 260. In the present implementation, the steering actuator 258 is a rotary hydraulic actuator, but other types of steering actuators 258 are contemplated.

Figure 2:
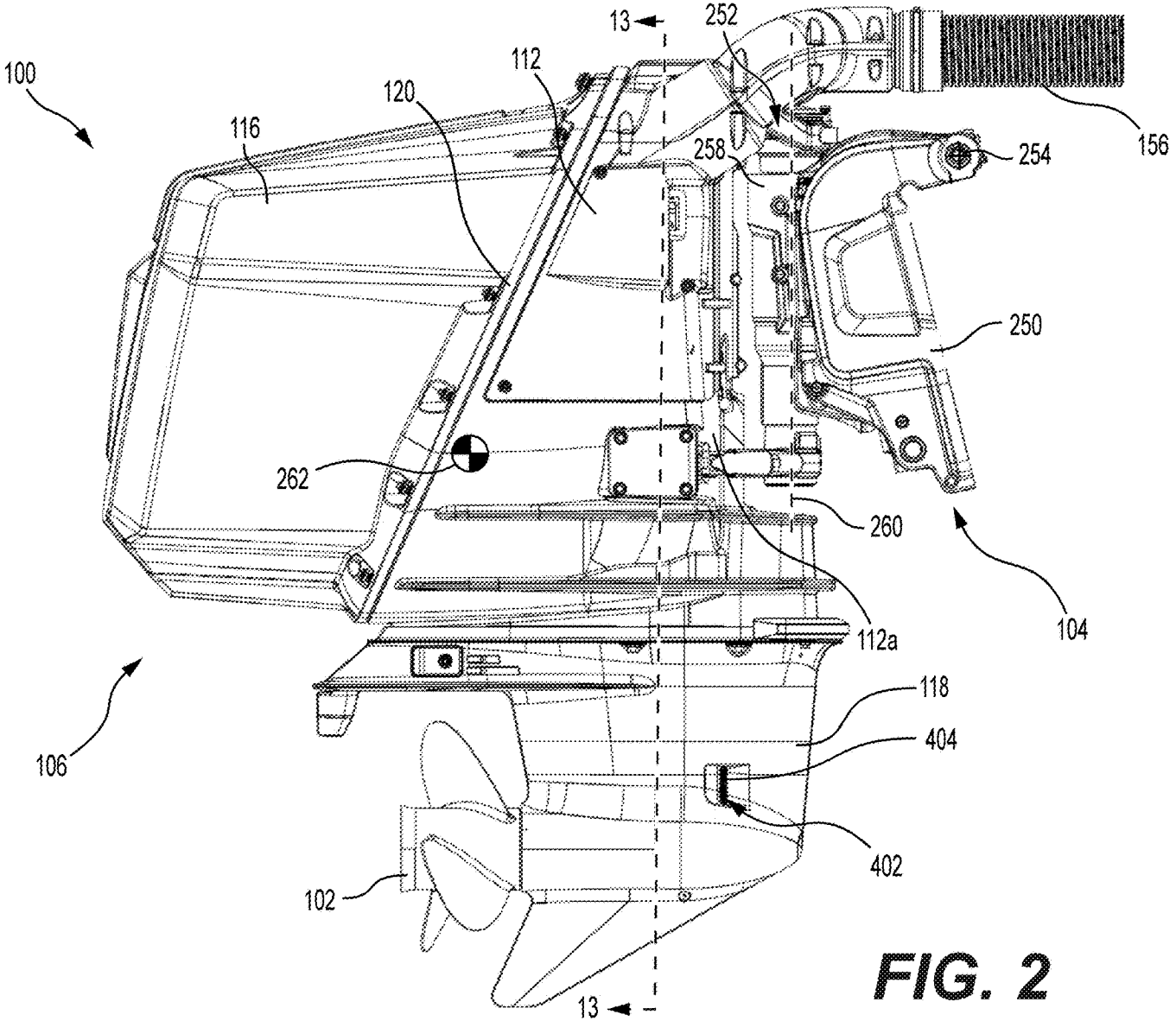
FIG. 2 is a right side elevation view of the marine engine assembly of the watercraft of FIG. 1.

As can be seen in FIG. 2, a center of gravity 262 of the engine 108 is disposed below the tilt-trim axis 254, when the assembly 100 is in a trim range. As the assembly 100 is designed to be disposed below the deck 22, the engine 108 and the transom bracket 104 are partially vertically aligned, rather than the engine 108 being disposed well above the bracket 104 as would be the case in a conventional outboard engine assembly meant to extend higher relative to the watercraft body 12. In the present implementation, the center of gravity 262 is vertically between a top end of the transom bracket 104 and a bottom end of the transom bracket 104.

Turning now to FIGS. 3, 4, 12 and 15, the driveshaft assembly 110 will be briefly described. The driveshaft assembly 110 has a driveshaft 302 coaxial with the crankshaft 152. The driveshaft 302 has a rear end received in the front end of the crankshaft 152 and directly connected to the crankshaft 152 by splines 304 (FIG. 8) such that the crankshaft 152 drives the driveshaft 302. The driveshaft 302 rotates about the crankshaft axis 152*a*. The front end of the driveshaft 302 is housed in the inner housing 114 and extends in a hollow driveshaft 308 disposed in the chamber 128. It is contemplated that the driveshaft 302 could connect to the crankshaft 152 by means other than splines 304, such as by threads for example. It is also contemplated that the crankshaft 152 and the driveshaft 302 could be integrally formed as a single shaft. The driveshaft 302 is connected to the driveshaft 308 by threads. The driveshaft 308 is operatively connected to the driveshaft 310 by a bevel gear 312 (FIG. 15). The bevel gear 312 is mounted to the driveshaft 308 between the front and rear ends of the driveshaft 308. The bevel gear 312 is mounted to the driveshaft 308 by splines, but other means are contemplated. The driveshaft 310 extends perpendicularly to the crankshaft 152, the driveshafts 302, 308 and the propeller shaft 132. The driveshaft 310 rotates about a rotation axis 313 being perpendicular to the crankshaft axis 152*a*. The driveshaft 310 is below the driveshafts 302, 308. A bevel gear 314 is mounted to the upper end of the driveshaft 310 and engages the bevel gear 312 in the chamber 128 such that the driveshaft 308 drives the driveshaft 310 via the bevel gears 312, 314. A pinion gear 316 is mounted to the lower end of the driveshaft 310 and drives the transmission 130, which in turn selectively drives the propeller shaft 132 and the propeller 102. In the present implementation, the pinion gear 316 is a bevel gear. The upper end of the driveshaft 310 is housed in the inner housing 114 while the lower end of the driveshaft 310 extends out of the inner housing 114 and is housed in the gearcase 118. It is contemplated that the driveshaft 310 could extend otherwise in other implementations.

Turning now to FIGS. 2 to 6, 18 and 20, a cooling system 400 of the marine engine assembly 100 will be described. The cooling system 400 uses water from the body of water on which the marine engine assembly 100 is operated to cool itself. The cooling system 400 includes two water intakes 402 (FIG. 2) defined on either side of the gearcase 118. The water intakes 402 have grates 404 to filter out relatively large particles and/or debris from the water entering the cooling system 400. A gearcase cooling water passage 406 (FIG. 4) is defined in the gearcase 118 to fluidly connect the water intakes 402 to an inlet 410 of a water pump 412 housed in the lower portion of the inner housing 114. The water pump 412 is a rotary pump driven by the driveshaft 310. The water pump 412 has an outlet 414 defined above the inlet 410. The outlet 414 is fluidly connected to inner housing cooling water passages 420 (FIG. 15) formed in the inner housing 114. The cooling water that is supplied by the water pump 412 flows in the inner housing cooling water passages 420 as indicated by arrow 421 and onto various components of the marine engine assembly 100 in order to lower temperature and/or maintain temperature within operating range of these components.

Figure 17:
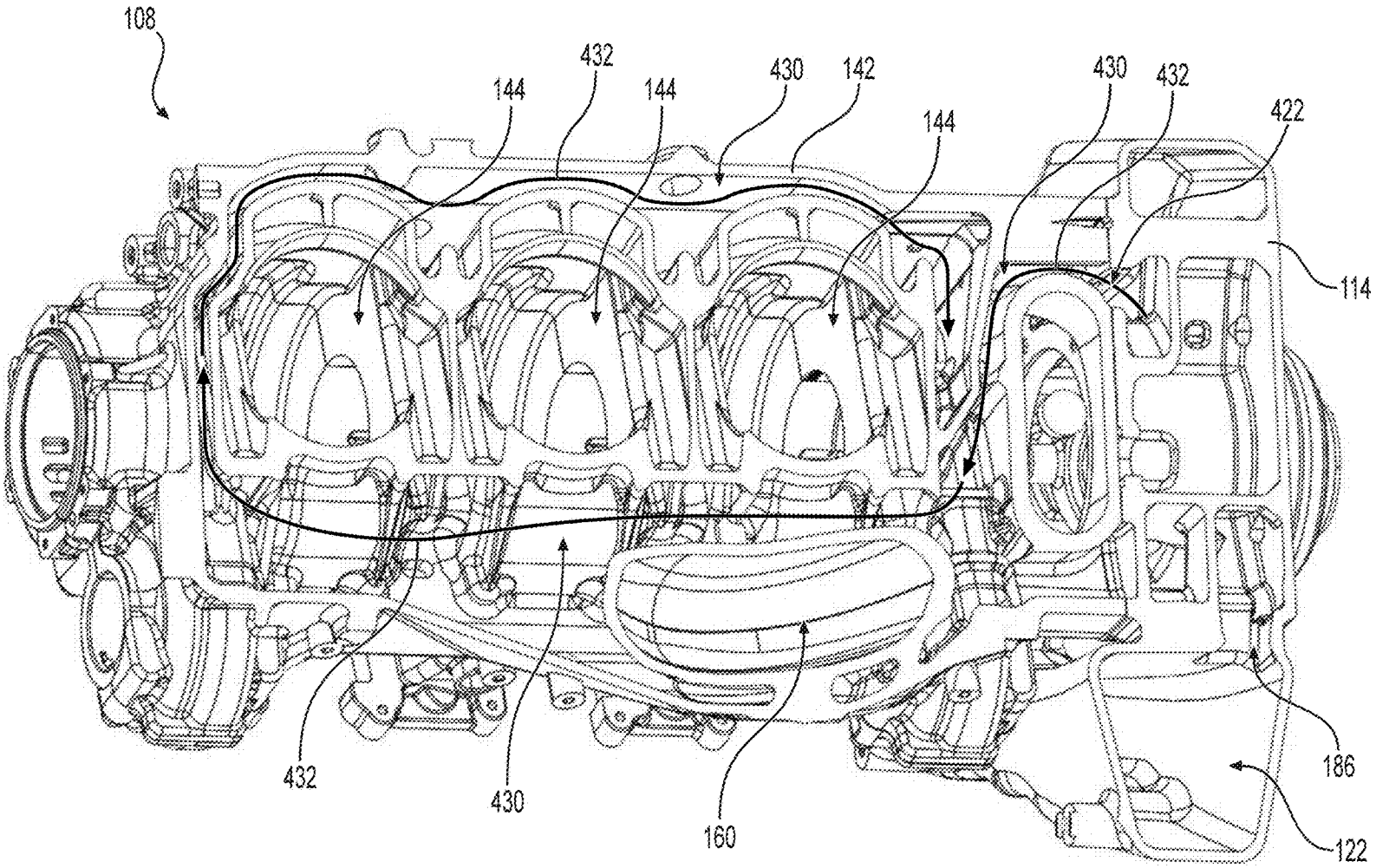
FIG. 17 is a cross-sectional view of the inner housing and the cylinder block of FIG. 16 taken through line 17-17 of FIG. 16.
Figure 20:
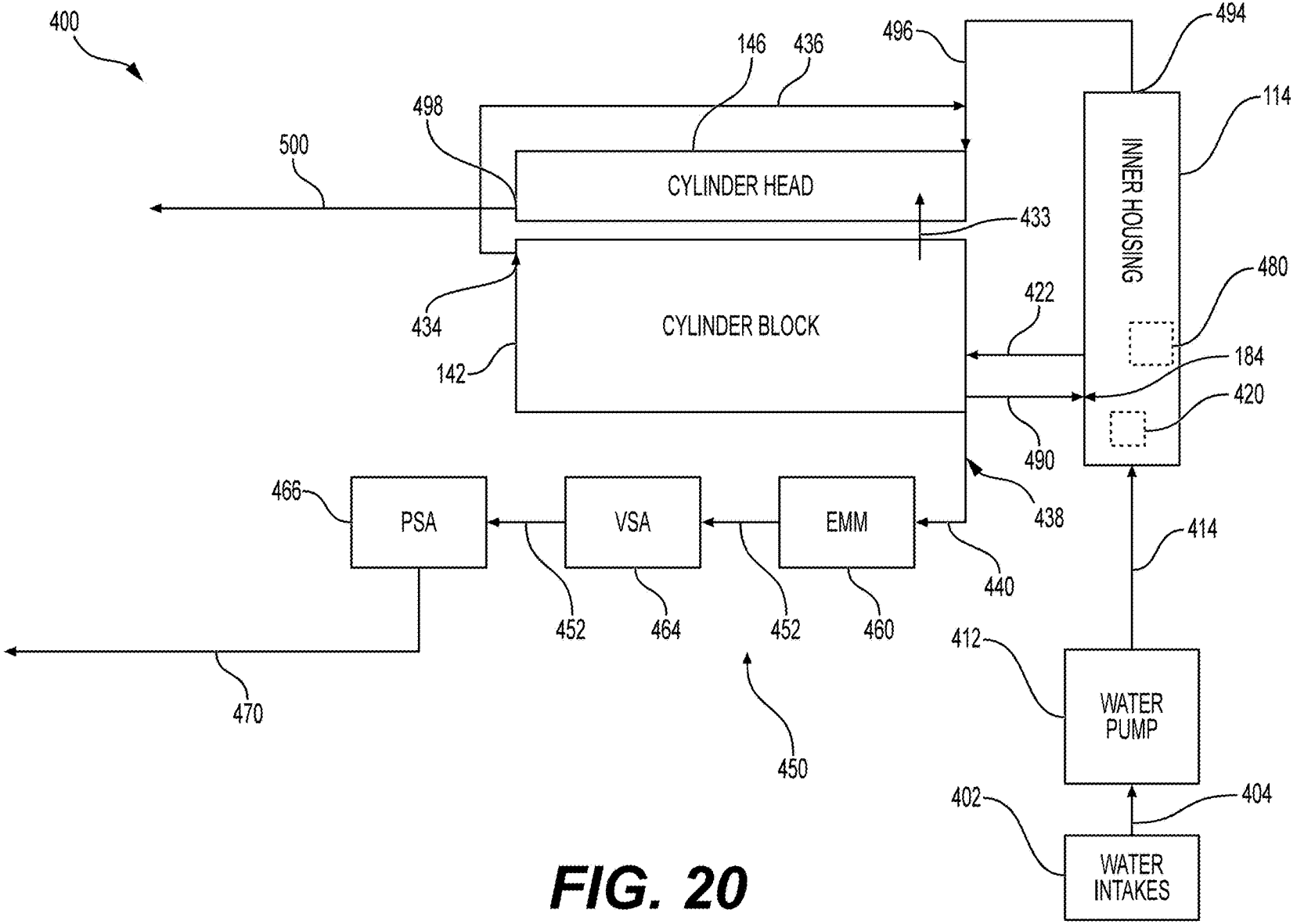
FIG. 20 is a flowchart of a cooling system of the marine engine assembly of FIG. 2.

From the inner housing cooling water passages 420, cooling water flows through the cooling water outlet 422 (FIGS. 13 and 18) defined in the inner housing 114 and into engine cooling water passages 430 defined in the cylinder block 142. As best seen in FIG. 17, the engine cooling water passages 430 are defined around the cylinders 144. Cooling water flows as indicated by arrows 432 shown in FIGS. 17 and 18. Cooling water flows from the engine cooling water passages 430 to cylinder head water cooling passages (not shown) defined in the cylinder head 146 as indicated by arrow 433 in FIG. 20. Referring to FIGS. 5, 6 and 20, a cylinder block vent 434 is defined in the cylinder block 142 and allows air to escape the engine cooling water passages 430 and for the cooling water to flow out of the engine cooling water passages 430. A conduit 436 is fluidly connected to the cylinder block vent 434 and extends forwardly above the cylinder block 142. Another cylinder block vent 438 (FIGS. 6 and 20) is defined on the right side of the cylinder block 142. A conduit 440 is fluidly connected to the cylinder block vent 438 and allows flow of cooling water from the engine cooling water passages 430 therein. The conduit 440 is part of a cooling circuit 450 that provides cooling water to different components of the marine engine assembly 100. Notably, the cooling circuit 450 includes other conduits 452 providing cooling water to an engine management module 460 (EMM in FIG. 20), a vapor separator assembly 464 (FIG. 5, VSA in FIG. 20) and a power steering assembly 466 (FIGS. 5 and 6, PSA in FIG. 20) one after the other in series. A conduit 468 (FIG. 6) directs water from the power steering assembly 466 to a water discharge passage 470 (FIGS. 15 and 18) defined in the inner housing 114. Water flows in the water discharge passage 470 and then into the exhaust passage 122 as indicated by arrow 472 (FIG. 19). Water mixes with the exhaust gases flowing in the exhaust passage 122 and cools the exhaust gases. The mixture of exhaust gases and water flows in a gearcase discharge passage 474 defined in the gearcase 118. In the present embodiment, the gearcase discharge passage 474 is the exhaust passage 134, but they could be distinct passages in other embodiments. The gearcase discharge passage 474 has an outlet 476 (in the present embodiment, the channels 176) and discharge water is expelled through the propeller 102 along with exhaust gases.

Figure 13:
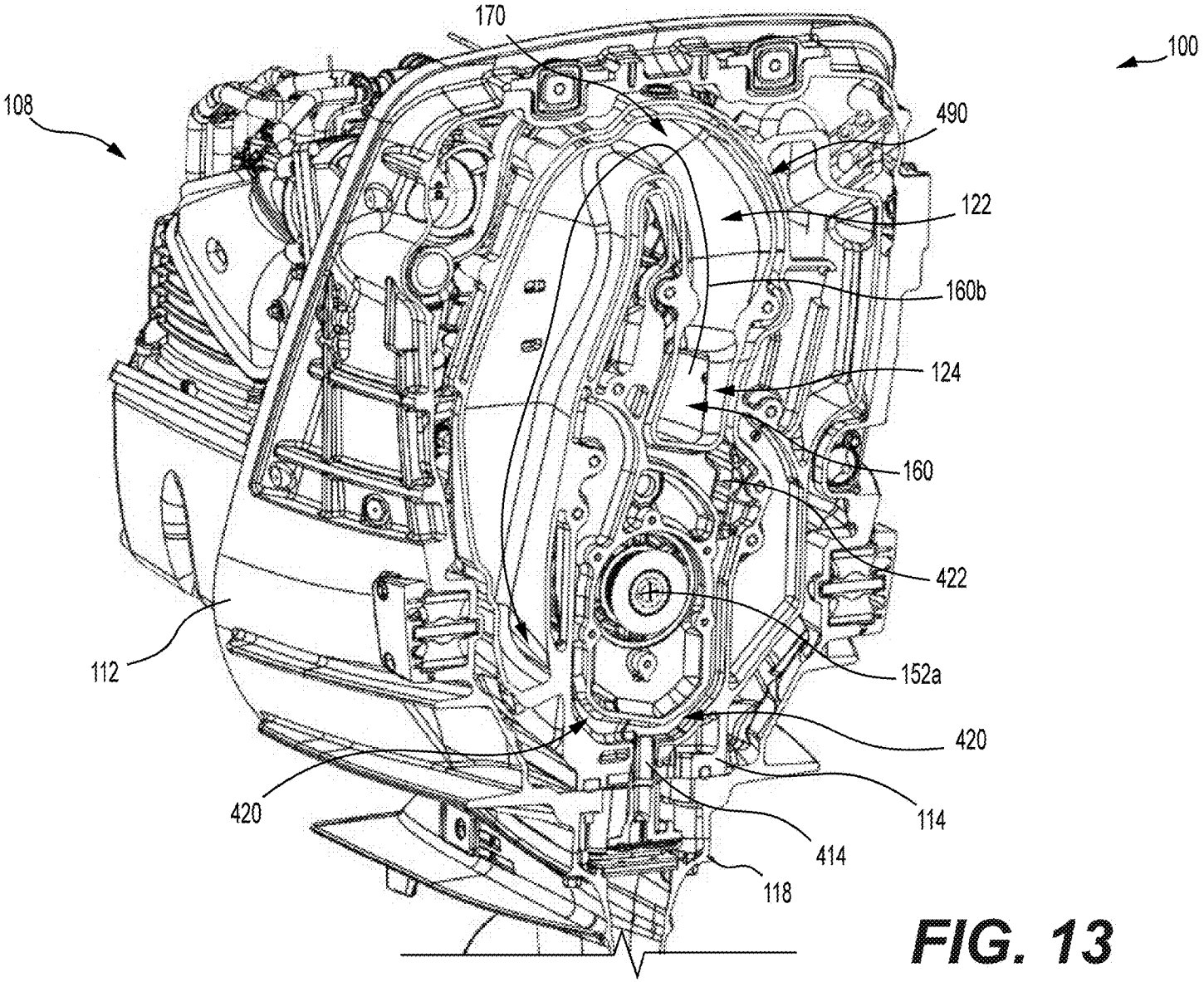
FIG. 13 is a perspective view taken from a top, front, right side of a cross-section of the marine engine assembly of FIG. 2 taken through line 13-13 of FIG. 2, with a cover of the housing omitted.

From the inner housing cooling water passages 420, cooling water also flows into driveshaft assembly cooling water passages 480 (FIGS. 4, 12 and 18) for cooling the driveshaft assembly 110. Referring to FIGS. 13 and 15, exhaust cooling water passages 490 are defined in the inner housing 114. Cooling water flows in the exhaust cooling water passages 490 from the inner housing cooling water passages 420 as indicated by arrows 492 in FIG. 15. The exhaust cooling water passages 490 surround a portion of the high rise exhaust passage 122. It is contemplated that the exhaust cooling water passages 490 could surround a greater or smaller portion of the high rise exhaust passage 122 in other implementations. A vent 494 (FIG. 18) is defined in the region proximate the apex 170 of the high rise exhaust passage 122 and allows air to escape from the exhaust cooling water passages 490 and to cooling water to flow out of the exhaust cooling water passages 490. Cooling water flowing through the vent 494 is directed toward the cylinder head 146 via a conduit 496 (FIG. 6). The cooling water flowing in the conduit 436 and the conduit 496 mix and enter cylinder head 146 cooling water passages to cool the cylinder head 146. A water outlet 498 (schematically shown in FIG. 20) is defined in the cylinder head 146 and is fluidly connected to a discharge passage 500 (schematically shown in FIG. 20) defined on the left side of the marine engine assembly 100 to discharge the cooling water to an exterior of the marine engine assembly 100. The exhaust cooling water passages 490 also surround a portion of the idle relief exhaust system 184 for cooling the idle relief exhaust system 184. The cooling system 400 further includes a cooling system flush port 510 (FIG. 18) defined in the inner housing 114 for purging the cooling system 400 using compressed air. It is contemplated that the cooling system 400 could differ from the one described above in other implementations, and could include, for example, closed circuits for cooling water to flow therein.

Modifications and improvements to the above-described implementations of the present technology may become apparent to those skilled in the art. The foregoing description is intended to be exemplary rather than limiting.

What is claimed is:

1. A marine engine assembly for a watercraft comprising:

a housing including an outer housing having a front wall, an inner housing disposed in the outer housing and being connected to the outer housing by at least one housing fastener disposed at at least one first position, the inner housing forming a high rise exhaust passage, a cover removably connected to the outer housing, and a gearcase connected to a lower portion of the outer housing;

an internal combustion engine having a front face connected to and supported by the inner housing by at least one engine fastener disposed at at least one second position being different from the at least one first position, the inner housing being disposed at least in part between the front face of the internal combustion engine and the front wall of the outer housing, the internal combustion engine and the inner housing being housed in a volume defined between the outer housing and the cover, the internal combustion engine further comprising a crankshaft defining a crankshaft axis, the crankshaft axis intersecting the front wall of the outer housing;

a driveshaft assembly comprising a driveshaft being operatively connected to the crankshaft and extending perpendicular to the crankshaft axis, the driveshaft being housed at least in part in the gearcase; and a propulsion device supported by the gearcase and being operatively connected to the crankshaft through the driveshaft assembly.

2. The marine engine assembly of claim 1, wherein:

the at least one housing fastener includes a first plurality of housing fasteners and a second plurality of housing fasteners;

the first plurality of housing fasteners extends above the at least one engine fastener; and the second plurality of housing fasteners extends below the at least one engine fastener.

3. The marine engine assembly of claim 2, wherein the first plurality of housing fasteners includes first threaded fasteners connecting an upper portion of the inner housing to an upper portion of the outer housing.

4. The marine engine assembly of claim 2, wherein the second plurality of housing fasteners includes second threaded fasteners that extend upwards through the lower portion of the outer housing and into the inner housing to connect a lower portion of the inner housing to the lower portion of the outer housing.

5. The marine engine assembly of claim 4, wherein the second threaded fasteners are disposed around the driveshaft.

6. The marine engine assembly of claim 1, wherein the front wall of the outer housing defines at least one aperture at least partially aligned with the at least one engine fastener, the at least one aperture granting access to the at least one engine fastener.

7. The marine engine assembly of claim 6, further comprising at least one cap disposed in the at least one aperture and being removably connected to the front wall of the outer housing for selectively granting access to the at least one engine fastener.

8. The marine engine assembly of claim 1, wherein the at least one engine fastener includes a plurality of engine fasteners, and the engine fasteners of the plurality of engine fasteners extend forwardly from the front face of the internal combustion engine and through the inner housing to connect the front face of the internal combustion engine to the inner housing.

9. The marine engine assembly of claim 8, wherein the engine fasteners of the plurality of engine fasteners are disposed above the crankshaft.

10. The marine engine assembly of claim 1, wherein the driveshaft assembly is housed at least in part in the inner housing.

11. The marine engine assembly of claim 1, wherein the driveshaft is housed at least in part in the inner housing.

12. The marine engine assembly of claim 1, wherein:

the driveshaft is a first driveshaft;

the driveshaft assembly further comprises a second driveshaft operatively connected to the first driveshaft;

the second driveshaft is perpendicular to the first driveshaft;

the second driveshaft is operatively connected to the crankshaft; and the propulsion device is operatively connected to the first driveshaft.

13. The marine engine assembly of claim 1, further comprising an exhaust system for supplying exhaust gases from the internal combustion engine to an exterior of the marine engine assembly, the exhaust system including the high rise exhaust passage, the internal combustion engine defining exhaust outlets fluidly communicating with the exhaust system, the high rise exhaust passage of the inner housing having an inlet and an outlet, the inlet of the high rise exhaust passage fluidly communicating with the exhaust outlets of the internal combustion engine; and the outlet of the high rise exhaust passage fluidly communicating with the gearcase for supplying at least some of the exhaust gases from the exhaust outlets to the gearcase.

14. The marine engine assembly of claim 13, wherein the exhaust system further comprises an idle relief exhaust system including an idle relief passage defined in the inner housing, the idle relief passage being fluidly connected to the high rise exhaust passage between the inlet and the outlet of the high rise exhaust passage.

15. The marine engine assembly of claim 1, further comprising a cooling system including:

at least one water intake defined in the gearcase;

a water pump housed in at least one of the gearcase and the inner housing, the water pump having an inlet fluidly connected to the at least one water intake and an outlet; and inner housing cooling water passages formed in the inner housing and fluidly connected to the outlet of the water pump.

16. The marine engine assembly of claim 15, further comprising engine cooling water passages fluidly connected to the inner housing cooling water passages for cooling the internal combustion engine.

17. The marine engine assembly of claim 15, further comprising driveshaft assembly cooling water passages fluidly connected to the inner housing cooling water passages for cooling the driveshaft assembly.

18. The marine engine assembly of claim 15, further comprising exhaust cooling water passages defined in the inner housing and being fluidly connected to the inner housing cooling water passages, the exhaust cooling water passages surrounding at least a portion of the high rise exhaust passage.

19. The marine engine assembly of claim 15, wherein the cooling system includes at least one conduit fluidly connected to the inner housing cooling water passages for providing cooling water to at least one of an engine management module, a fuel injector assembly, a vapor separator assembly and a power steering system of the marine engine assembly.

20. The marine engine assembly of claim 19, wherein the at least one conduit provides cooling water to the engine management module, the vapor separator assembly and the power steering system of the marine engine assembly.

21. The marine engine assembly of claim 15, wherein the inner housing defines at least one water discharge passage fluidly connected to a gearcase discharge passage defined in the gearcase.

22. The marine engine assembly of claim 1, further comprising:

a steering actuator connected to the front wall of the outer housing; and a trim actuator connected to the front wall of the outer housing.

* * * * *